US006364199B1

(12) United States Patent
Rose

(10) Patent No.: US 6,364,199 B1
(45) Date of Patent: Apr. 2, 2002

(54) CONTAINER HAVING A PLURALITY OF SELECTABLE VOLUMES

(76) Inventor: Harold J. Rose, 18 Windham Dr., Concord, NH (US) 03301-5836

( * ) Notice: Subject to any disclaimer, the term of this patent is extended or adjusted under 35 U.S.C. 154(b) by 0 days.

(21) Appl. No.: 09/632,785

(22) Filed: Aug. 4, 2000

Related U.S. Application Data

(63) Continuation-in-part of application No. 09/039,175, filed on Mar. 13, 1998, now Pat. No. 6,119,929, which is a continuation-in-part of application No. 08/940,390, filed on Oct. 1, 1997, now abandoned.

(51) Int. Cl.[7] ..... B65D 5/54

(52) U.S. Cl. ..... 229/101; 229/101.1; 229/101.2; 229/931

(58) Field of Search ..... 229/117.01, 101, 229/101.1, 101.2, 931

(56) References Cited

U.S. PATENT DOCUMENTS

| | | | | | |
|---|---|---|---|---|---|
| 1,125,535 | A | | 1/1915 | Hoffman | |
| 1,516,090 | A | | 11/1924 | Gary et al. | |
| 1,636,838 | A | | 7/1927 | Roser | |
| 1,763,025 | A | * | 6/1930 | Van Wormer | 229/117.01 |
| 1,767,274 | A | | 6/1930 | Broderick | |
| 1,808,833 | A | | 6/1931 | Brack | |
| 1,846,949 | A | | 2/1932 | Clark | |
| 2,020,804 | A | * | 11/1935 | Segal | 229/101.1 |
| 2,056,032 | A | * | 9/1936 | Berman | 229/101.1 |
| 2,112,143 | A | * | 3/1938 | Costa et al. | 229/101.1 |
| 2,210,302 | A | | 8/1940 | Petter | |
| 2,251,283 | A | * | 8/1941 | Johnson | 229/117.01 |
| 2,279,381 | A | | 4/1942 | Richardson | |
| 2,281,707 | A | * | 5/1942 | Mott | 229/101.1 |
| 2,329,797 | A | * | 9/1943 | Strack | 229/101.1 |
| 2,382,891 | A | | 8/1945 | McCormick | |
| 2,454,013 | A | | 11/1948 | Scherzinger | |
| 2,666,566 | A | * | 1/1954 | Mulnix | 229/101 |
| 2,697,545 | A | * | 12/1954 | Radin | 229/117.01 |
| 2,750,101 | A | * | 6/1956 | Jacke | 229/101.2 |
| 2,936,239 | A | | 5/1960 | Rendall | |
| 3,128,031 | A | | 4/1964 | Dembo | |
| 3,180,556 | A | * | 4/1965 | Asman | 229/101.1 |
| 3,302,855 | A | * | 2/1967 | Becker | 229/101.1 |
| 3,313,467 | A | | 4/1967 | Anderskow et al. | |
| 3,486,682 | A | * | 12/1969 | Mahon et al. | 229/101.1 |
| 3,598,303 | A | | 8/1971 | Folz | |
| 3,998,378 | A | | 12/1976 | Vetten | |
| 4,052,932 | A | | 10/1977 | Huiskes | |
| 4,530,459 | A | | 7/1985 | Maroszek | 229/101 |
| 4,592,464 | A | | 6/1986 | Londagin | |
| 4,856,709 | A | | 8/1989 | Axelsson et al. | |
| 5,016,753 | A | | 5/1991 | Henderson | |
| 5,197,659 | A | | 3/1993 | Vassiliou | |
| 5,671,883 | A | | 9/1997 | Philips | |
| 5,829,671 | A | * | 11/1998 | Hawk | 229/125.03 X |
| 6,138,901 | A | | 10/2000 | Kim et al. | |

FOREIGN PATENT DOCUMENTS

| | | |
|---|---|---|
| DE | 24 37 862 | 2/1975 |

* cited by examiner

*Primary Examiner*—Nathan J. Newhouse
*Assistant Examiner*—Tri M. Mai
(74) *Attorney, Agent, or Firm*—Nixon Peabody LLP

(57) ABSTRACT

A container having a plurality of selectable volumes having a bottom portion, two side panels, and two end panels with lateral perforations extending across these panels to allow removal of at least a portion thereof. Each of the two end panels includes hypotenuse creases adapted to allow the two end panels to be selectively inwardly folded to thereby form a top closure for the container with a portion of the two side panels. In addition, the containers may be provided with a vertical perforation, a closure flap with side flaps, and identifiable marking to facilitate identification of the perforations and hypotenuse creases. Moreover, the container may also include a plurality of fold facilitating creases laterally extending across the two side panels and the two end panels, as well as through-holes on the hypotenuse creases.

37 Claims, 7 Drawing Sheets

CONTAINER HAVING A PLURALITY OF SELECTABLE VOLUMES

This application is a Continuation-In-Part of a application Ser. No. 09/039,175 filed Mar. 13, 1998 U.S. Pat. No. 6,119,929 which is a Continuation-In-Part of application Ser. No. 08/940,390 filed Oct. 1, 1997 now abandoned.

BACKGROUND OF THE INVENTION

1. Field of the Invention

This invention most generally relates to containers. More particularly the invention relates to containers which may be folded in a manner so as to create a selected volume for the container. Most particularly, the invention relates to mailing or shipping containers made of cardboard, corrugated cardboard, boxboard or the like, which are foldably adjustable with respect to a height dimension and consequent volume in order to accommodate articles or collections of articles having a specific volume. The variable volume container thus eliminates the need for post offices and other mailing and shipping businesses to have to purchase and stock a great variety of sizes of boxes and containers. Storage of variable volume boxes is more efficient, and consumers purchasing boxes for shipping do not have to worry about or guess what size box is appropriate for their packages.

2. Description of the Prior Art

Various folding box designs which are foldable from a one-piece blank are known in the art. In this regard, a typical foldable box blank has primary folding lines which may be perforations, indentations, slits, scoring, cuts or any other weakening lines which provide weakening of the integrity of the unfolded box blank so that the box may be formed by folding at the weakening lines. Such foldable box blanks are usually cut or stamped from a flat sheet of, for example, cardboard. The die used to stamp the blank also scores the blank along selected lines, to enable a person to easily fold the blank along such scores to create the finished container. Some examples of known foldable containers include a typical pizza box, milk carton, and a box used to ship books.

The primary disadvantage with most of the types of boxes discussed above, especially for those in the mailing and shipping fields, is that the box blank can form a box of only one size. Therefore, finished boxes have a fixed and predetermined volume. If a person buys a box, and it is not the right size for the item being shipped, another box must be acquired or the box must be cut down with a sharp instrument such as a knife. Companies that are in the business of packaging goods and mailing and shipping of goods must stock and carry many differently sized boxes or box blanks. In addition, if a box is too big for an item and sufficient packing is not included when the item is packed, there is increased risk of damage to the item or injury to a person carrying the box or container. In particular, the item which is loose in the box may quickly shift if the box is tilted, thus possibly causing damage to the item by hitting the sides of the container, or causing damage to the item or person carrying it when the box is accidentally dropped due to the sudden, unexpected shift of weight. Furthermore, if a force is applied near the top center of a partially filled box, the tape that secures the box can be forced loose.

As a result, various boxes have been designed to be able to form finished boxes having various selectable volumes, thus reducing manufacturing and storage costs, reducing inconvenience for customers attempting to select a container of proper size, and reducing damage to persons and property due to items being placed in inappropriately sized containers. For instance, a book-shipping box known to Applicant comprises a flat rectangular bottom portion with four extending flaps which are each scored along the edge of the bottom portion and at two or three distances out from the flat bottom portion. The scoring enables the flaps to be folded up to different heights to accommodate books of different thicknesses but the corners of the formed boxes remain uncovered. Other examples of boxes having various selectable volumes include U.S. Pat. No. 2,382,891 to McCormick, U.S. Pat. No. 3,302,855 to Becker, U.S. Pat. No. 3,313,467 to Anderskow, and German patent document No. 24 37 862.

In particular, U.S. Pat. No. 2,382,891 to McCormick discloses a box with extending flaps which can be used to close the box. The reference also discloses a plurality of horizontal creases on the side walls of the box and corner creases in the form of a cut-score or perforation being provided at the corners of the box where the side walls are joined. The perforation allows the corner of the side walls to be separated and the side walls to be folded along the horizontal creases to thereby provide a box having various selectable volumes. Despite the advantages provided by prior art box having various selectable volumes, actually changing the volumes on such a box have been found to be very difficult and consequently, noted prior art boxes having various selectable volumes have not gained in popularity in the market place.

It is also known in the art to provide containers such as milk cartons that have openings which are shaped differently than most storage or shipping boxes. These containers have end panels with triangularly shaped score lines which allow the end panels to be folded and thereby close the opening. In addition, such containers also allow a spout to be formed to allow dispensing of the milk or other liquids contained therein. These cartons having triangularly shaped score lines, however, may only be formed to be one size. Furthermore, these cartons are designed to be left in a peaked shape and do not have a flat top surface when the carton is closed. Consequently, these cartons are not suitable for use as storage and shipping boxes since they cannot be easily stacked.

Lastly, U.S. Pat. No. 1,636,838 to Roser discloses a collapsible hand bag which may be configured to have various volumes. The reference discloses that the front and rear walls have a plurality of fold facilitating lines and that the end walls have triangularly shaped angled lines, these lines allowing configuration of the hand bag into various volumes. However, the reference is directed to the art of hand bags and does not disclose a container suitable for storage and shipping purposes. In addition, much like the milk carton prior art discussed above, when in use, the hand bag of Roser has a peaked shape and does not have a flat top surface in most of the configurations. Consequently, such designs are also not suitable for use as storage and shipping boxes since they cannot be easily stacked.

Therefore, in view of the above, there still exists an unfulfilled need for a container having various selectable volumes where the volume of the container can be easily changed. There also exists an unfulfilled need for such a container having a flat top surface when the container is closed so that the container can be stacked and used for storage and shipping purposes.

SUMMARY OF THE INVENTION

The invention is directed primarily to a container having a plurality of selectable volumes which selectable volumes are made by inwardly folding sides and ends of the container along selectable foldable creases. The invention may also be a container in unassembled form comprised of a flat blank sheet of material foldable to form walls and bottom and scribed or scored before or after assembly into the container, to provide for the selectable creasing and folding. The container may have any suitable use and particularly may be a shipping container or a storage container. Preferably the container, when assembled, is rectangular in cross sectional shape, and may be formed from cardboard, corrugated cardboard, or other suitably strong but creasable and foldable material. The container may be assembleable from a substantially flat form.

In accordance with the preferred embodiment of the present invention, the above objects are obtained by a container having a plurality of selectable volumes including a bottom portion having a substantially rectangular shape with two substantially parallel side edges and two substantially parallel end edges, two side panels attached to and extending upwardly from the two side edges of the bottom portion, and two end panels attached to and extending upwardly from the two end edges of the bottom portion, each of the two side panels having edges which are attached to edges of each of the two end panels to thereby form four corner edges of the container. The container also includes at least one perforation laterally extending substantially across the two side panels and the two end panels to allow removal of at least a portion of these panels, each of the two end panels including at least one set of hypotenuse creases adapted allow the two end panels to be inwardly folded to thereby form a top closure for the container with a portion of the two side panels. Preferably, the top closure is formed so that it has a flat top surface to allow stacking of containers.

In the preferred embodiment of the present invention, the container includes a plurality of perforations that laterally extend substantially across the two side panels and the two end panels to allow folding of these panels or to allow selective removal of at least a portion of these panels. In such an embodiment, each of the two end panels include a plurality of sets of hypotenuse creases adapted to allow selective inward folding of the two end panels to thereby allow selection of a volume for the container. Each of the plurality of sets of hypotenuse creases preferably include a first crease and a second crease, each of the first crease and the second crease extending upwardly from a corner edge of the container, and preferably, from an intersection of the corner edge and a perforation. In this regard, the first crease and the second crease of each of the plurality of sets of hypotenuse creases extend upwardly toward a central axis of an end panel and terminate at an intersection thereof. Preferably, this intersection is also on a perforation so that the first crease and the second crease terminate at a perforation. In addition, the end panels may be provided with a vertical perforation extending along the central axis between the plurality of sets of hypotenuse creases to allow folding of the end panels along the central axis. Furthermore, the container may further include a closure flap at an upper edge of one side panels for overlapping at least a part of the other side panel. The closure flap may also include side flaps which can be downwardly folded toward the two end panels of the container. Moreover, one or more of the perforations and the hypotenuse creases may be provided with an identifiable marking to facilitate identification of the perforations on the two side panels and the two end panels.

In accordance with yet another embodiment of the present invention, the container having a plurality of selectable volumes may include a plurality of fold facilitating creases laterally extending substantially across the two side panels and the two end panels to allow selective folding of these panels. Preferably, these plurality of fold facilitating creases are positioned on the two side panels and the two end panels at a height distance less than that of the plurality of perforations. In addition, the plurality of sets of hypotenuse creases extends upwardly from an intersection of the corner edge and at least one of a perforation and a fold facilitating crease, and terminates at an intersection with a perforation. A through hole may be provided at this intersection with the perforation to facilitate folding of the container. Furthermore, the container may also include a vertical perforation to facilitate the removal of a portion of the two side panels and the two end panels. Preferably, the vertical perforation is provided on each of the four corner edges of the container. Of course, at least one of the plurality of fold facilitating creases may also be provided with an identifiable marking as well.

The invention has the particular objectives, features and advantages of: 1) being less costly to a reseller because fewer sizes of basic container need to be retained in stock in order to accommodate many sub-sizes; 2) adjustable volume allowing container to hold items more snugly, with less internal movement, thus in some cases eliminating or at least reducing the need for additional packing material, thereby reducing shipping/packaging cost; 3) a variable volume container is advantageous for a catalog merchant who ships varied items and/or quantities in a single box; 4) the container is more environmentally friendly, by reducing the need for extra packing material; 5) less time would be spent in a shipping department figuring out what size container to use for a variety of products; 6) adjustable size is likely cheaper to ship because the appropriate smaller sizes could be selected, thus reducing space for shipping, reducing the number of parcel containers, airplanes, and trailers needed for shipping and consequently reducing the total number of miles driven, gas used, maintenance and repair costs and labor costs; 7) having filled containers ready for shipping which take up less warehouse space, thereby reducing cost; 8) saving on storage space for packing material; 9) all versions of the invention increase safety by eliminating the need to use any type of sharp blade to reduce the volume of a box; 10) cutting down the corners of a container by hand with a sharp blade in order to reduce its volume usually produces cuts of different length and/or cuts that are not straight, resulting in a container, once it is sealed, that is uneven/asymmetrical and therefore not only unpleasing to the eye, but also difficult and unsafe to stack; 11) an embodiment of the invention with precut sealing strips increases efficiency and saves time at the Post Office, because postal clerks would no longer have to tape boxes for customers, thereby saving the Post Office labor time and cost of materials for taping, and saving time for all customers, especially those waiting in line; 12) savings in damage and replacement cost for items damaged in shipping due to internal movement of the item within a container too large for the item; 13) being available in several base adjustable sizes, and being available in heavy and light weight versions, for various goods; 14) being more cost effective for consumers who wouldn't have to buy, along with a box, a package of packing material, and a full roll of tape or other sealing material—an appropriately sized container with just the right amount of sealing material would be available as a kit; 15) providing a more robust container which can be more effectively packaged, sealed and stacked; 16) providing a cost effective and economically viable container having variable volumes; 17) providing cost and volume savings since only one model of box need be manufactured and/or purchased; and 18) providing a container which may be reused at a same volume configuration or a smaller volume configuration.

These and further objects of the present invention will become apparent to those skilled in the art to which this invention pertains after a study of the present disclosure of the invention.

DESCRIPTION OF THE PREFERRED EMBODIMENTS

Figure 1:
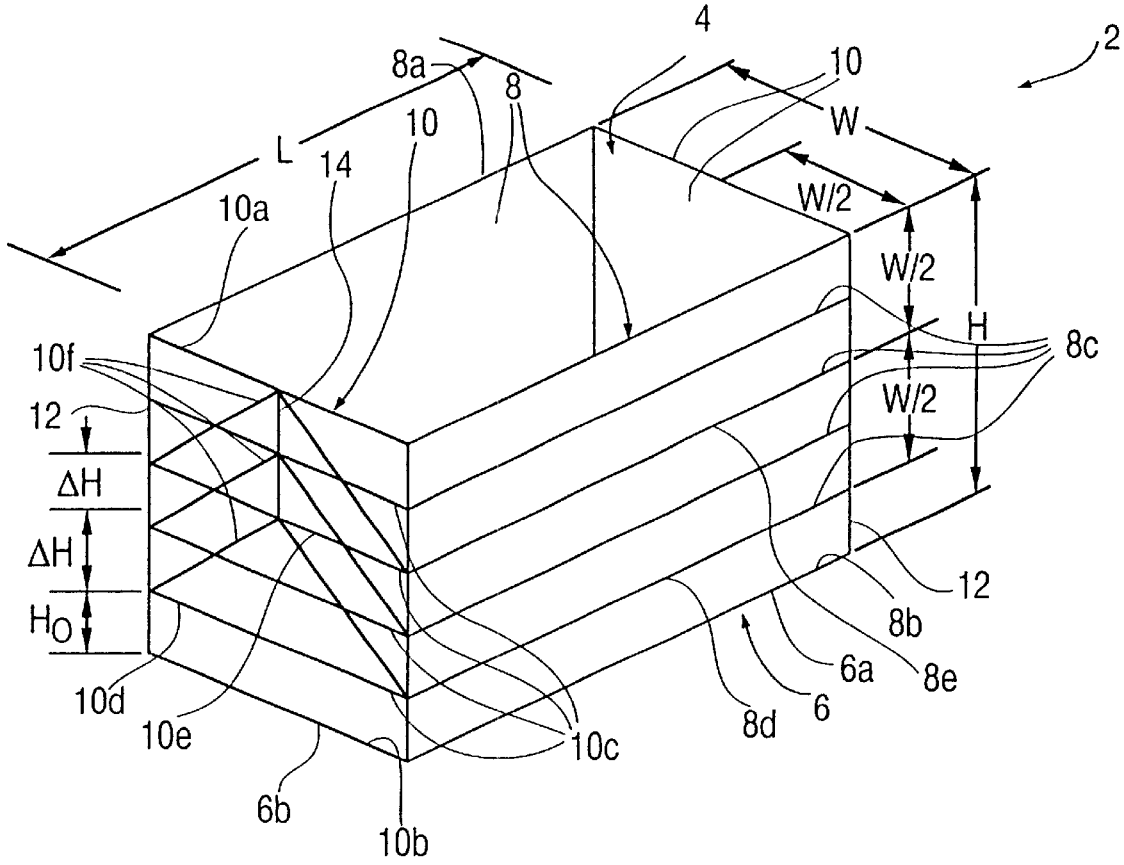
FIG. 1 is a perspective view of the container of one embodiment of the variable volume container of the present invention, showing the container in an unfolded position, with a set of cooperating fold facilitating creases formed in the container.

The following is a description of the preferred embodiments of the invention. It is clear that there may be variations in the size and the shape of the variable volume container, and in the materials used in the construction. The particular embodiments to be described in detail herein will have three selectable volumes; that is the numeral "n" which is used to identify the number of selectable volumes has the particular value of three (3). Clearly, the number of possible volumes is in part governed by materials and both a minimum and a maximum size of the containers. The value of "3" for "n" is not to be deemed as limiting; it is merely the example used in this description. Also discussed and shown in the drawing figures is the particular case where the incremental height delta H ($\Delta H$) is substantially the same value. That is to say, that the changes in volume are incremental in that the volume height dimension increases by $\Delta H$ for each incremental volume increase. Clearly the change in height need not be in equal increments; however, most likely the container would be made in this manner. While the preferred material for the container would be cardboard or corrugated cardboard and the like, plastics or similar products which are creasable and foldable could be used.

Figure 2:
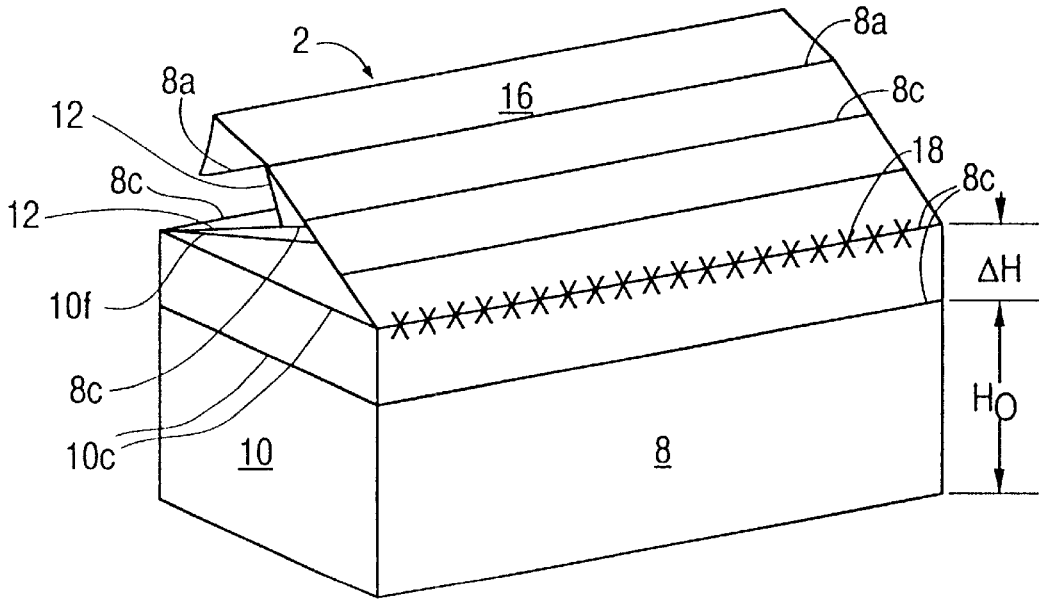
FIG. 2 is a perspective view of the embodiment shown in FIG. 1, showing a container of a particular kth volume, k=1 in this instance, partially formed wherein a particular set of cooperating fold facilitating creases is used to form a container of a particular volume. An optional closure flap is also shown.
Figure 3:
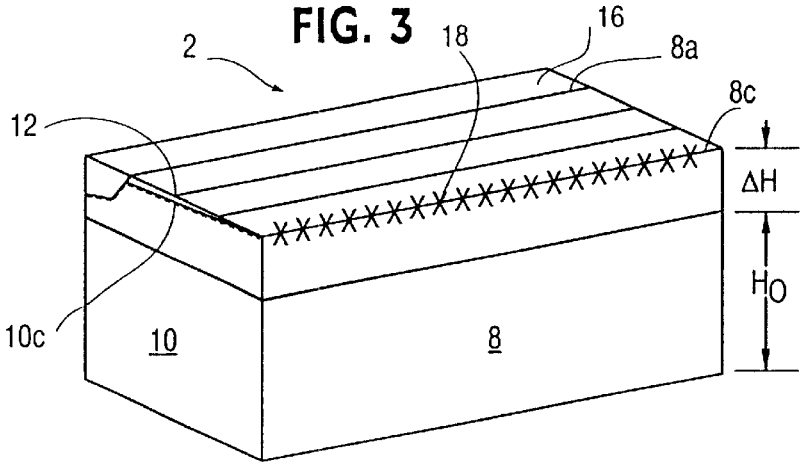
FIG. 3 is a perspective view of the embodiment of FIGS. 1 and 2 wherein a container of a particular kth volume, k=1 in this instance, has been formed and closed.

Reference is now made to the drawings in which similar embodiments are enumerated with like numerals in referring to like elements to thereby clarify the embodiments disclosed in the present application. There are discussed basically two embodiments of the invention, containers sometimes referred to herein as foldable container, which has pairs of triangularly shaped creases, called herein hypotenuse creases on end panels as schematically illustrated in FIGS. 1, 2 and 3 as well as in FIGS. 6 to 13B and there are containers 20 and 40, each sometimes referred to herein as tearable container 20 and tearable container 40, illustrated in FIGS. 4 and 5, each shown as having, in this instance, three selectable volumes. As shown, the embodiment of FIGS. 4 and 5 have tearable perforations 32 coincident with corners 30 where side panels 26 and end panels 28 join for container 20, and for container 40 pairs of perforations 32 each perforation 32 of the pairs of perforations being substantially parallel and spaced from corner 30 one perforation 32 of the pair being on sides 26 and the other on ends 28.

FIG. 1 shows container having a plurality of selectable volumes 2 (foldable container) with a plurality of pairs of hypotenuse creases 10*f* (in this instance three (3) pairs i.e., n=3). There is a perpendicular crease 14 on each end panel 10. Perpendicular creases 14 begin at a point located at the mid-point of the width dimension W (i.e., at ½ W) on top edges 10*a* of each end panel 10. Perpendicular creases 14 extend to the point where the lower-most pair of hypotenuse creases meet. Perpendicular creases 14 substantially bisect the 90 degree angle formed by the junction of each pair of hypotenuse creases 10*f*. There are four (4, i.e., n+1) sets of fold facilitating creases 8*c* on each of side panels 8. Each crease of each of the n+1 sets of creases is substantially parallel to side panel bottom edge 8*b*. There are four (4, i.e., n+1) sets of fold facilitating creases 10*c* on each of end panels 10. Each crease of each of the n+1 sets of creases is substantially parallel to end panel bottom edge 10*b*. Each hypotenuse crease of a pair of hypotenuse creases meets the cooperating creases 8*c* and 10*c* at one of the four corners 12 where side panel 8 meets end panel 10. The angle formed between a crease 10*c* and the intersecting hypotenuse crease is substantially about 45 degrees. I.e., the length of each hypotenuse crease is about 1.414 times one-half width dimension W. Alternately hypotenuse crease length is about 0.707 times width dimension W. Fixed dimension bottom portion 6 has parallel opposing bottom portion side edges 6*a* and parallel opposing bottom portion end edges 6*b*. Bottom portion 6 may be pre-assembled but may be assembleable from a substantially flat form. Bottom portion 6 is connected to two opposing parallel side panels 8 and two opposing parallel end panels 10 along side panel bottom edges 8*b* which have length L, and end panel bottom edges 10*b* which have width W, such that side panels 8, end panels 10 and bottom portion 6 join to form container 2 having corners 12 where side panels 8 meet end panels 10.

Open top 4 of container 2 is defined by side panel top edges 8*a* of two side panels 8 and end panel top edges 10*a* of two end panels 10. Folding of the material of each side panel 8 and each end panel 10, in a manner cooperating with the other side panel 8 and end panel 10, closes container 2 and thereby encloses a preselected volume $V_k$. Once formed to the desired volume, container 2 is sealed with a sealing material, preferably tape. Container 2, and bottom portion 6 have a fixed length dimension L, and a fixed width dimension W. Container 2 has a height dimension H determined by height dimension H of the side and end panels. For the minimum volume of container 2, side panel lower-most crease 8*d* and end panel lower-most crease 10*d* are used. Creases 8*d* and 10*d* are located a minimum volume height distance $H_0$ from bottom edges 8*b* and 10*b* respectively. For subsequently larger volumes, volume height $H_0+k\Delta H$, where k is either 1 or 2 in the instance shown in FIG. 1, determines the volume of the container; that volume height being the sum of the minimum height $H_0$ (the distance from the bottom edges 8*b* and 10*b* to the lower-most set of creases) and $k\Delta H$. Where incremental height $\Delta H$ is substantially equal between cooperating sets of creases, $\Delta H$ can be computed by taking the overall height H, subtracting $H_0$, then subtracting the quantity of one-half of the width dimension W, and dividing the result by the number of $\Delta H$'s going from the lower-most creases 8*d* and 10*d* to the upper-most or top-most volume determining fold facilitating creases 8*e* and 10*e*. In FIG. 1 there are two $\Delta H$'s i.e., for n=3 that meaning three volumes, the number of $\Delta H$'s is n−1 or in this instance two (2). In order to have complete closure of open top 4 for maximum volume $V_{n-1}$ here $V_2$, top-most volume determining fold facilitating creases 8*e* and 10*e* must be located about one-half container width W (½ W) from top edges 8*a* and 10*a*.

A closure flap 16 may be added to one of side panels 8 to facilitate more fully or more completely sealing the container.

For example, in a container 2 with 3 possible volumes, such as that shown in FIGS. 1, 2, and 3, n is the numeral 3, thus k as the subscript for a selected volume $V_k$ is chosen from the values 0, 1, and 2 (i.e., 0 to n−1) for designating the three possible volumes, $V_0$, $V_1$, $V_2$. For each selection of k for a particular volume $V_k$, a kth cooperating set of side and end panel creases 8*c* and 10*c* respectively is selected or specified. While there are four (4) sets of these creases 8*c* and 10*c* there are only three (3) sets of these creases which determine volume. The fourth (4th, i.e., n+1) is required to allow folding of the panels for medium volume $V_{n-2}$. In the container 2 there are a total of n+1 of sets of cooperating side and end panel creases, or 4 total side and end panel creases for the instance of n=3 selectable volumes. For each selection of k for a particular volume $V_k$ a kth cooperating set of side and end panel creases is selected or specified. Again, while there are four (4) sets of these creases 8*c* and 10*c* there are only three (3) sets of these creases which determine volume. For designating the number of pairs of hypotenuse creases 10*f*, k is chosen from the values 0, 1, and 2, which yields n number of pairs of hypotenuse creases 10*f*, in this case, 3 pairs of hypotenuse creases.

In general, however, container 2 has a particular volume $V_k$ wherein, for a specific numeral for k, the volume $V_k$ is a selectable volume selected from a plurality of selectable volumes. The total number of possible volumes is equal to n and finite, but preferably the number of volumes n is between about two and six for a given container. The container has a maximum and a minimum volume. For k=n−1, $V_{n-1}$ is a maximum volume and for k=0, $V_0$ is a minimum volume. The k=0 side and end panel creases will be the lower-most creases 8*d* and 10*d* respectively. The k=n−1 will designate the upper-most or top-most creases 8*e* and 10*e* which creases define the maximum volume. The (n+1)th set of creases are needed for closure of the top of the container when the volume $V_{n-2}$ is being formed. For foldable container 2 there are n+1 substantially parallel side and end panel creases. The kth panel-distance or what may be referred to as volume height is substantially about a minimum height dimension $H_0$ plus k times a delta H ($\Delta H$) where the $\Delta H$ is a predetermined, (but each $\Delta H$ need not necessarily be equal to each other $\Delta H$) fractional amount of the total height dimension H. The delta H is the spacing between consecutive side panel creases, and is preferably constant, making the spacing between side panel creases equal, however the spacing need not be equal. $\Delta H$ is preferably about equal to the height H minus the minimum height $H_0$ minus the distance of one-half W, the result divided by the integer n−1. For designating particular volumes the numeral k is selected from the numerals 0, 1, 2, 3, . . . , n−1. The numerical value of n, i.e., the number of possible volumes is a function of the container dimensions of length L, width W and height H and of the material composition of the container.

For k equal to n−1, which yields the maximum volume, the (n−1)th panel-distance is not greater than the height dimension H minus one-half W. If this was not the case, the top edges of the side panels would not meet when folded and the container could not be completely closed. The minimum height (i.e., for k=0) would be defined such that the top edges of the side panels, when joined by folding, would not extend beyond the opposing side of the container. However, it is possible, if a lesser minimum height was needed or desired, additional suitably placed fold facilitating creases could be positioned on the side and end panels so that the extending side panel top edges (which close the container and just meet when the container is used in the maximum volume position) could be folded over and down along the opposing side of the container. Additionally, although the example illustrated shows a container formed wherein the opposing top edges of the side panels which close the container meet each other, it is possible to "overstuff" the container, such that the side panels do not meet to filly close the container. The gap created thereby could be covered-over with suitable packaging material.

When a user of container 2 causes folding along the kth creases, all of the cooperating kth creases and the perpendicular creases result in the container closing at the open top, thereby enclosing within the container a selected volume $V_k$. The volume $V_k$ would equal the product of the length L, the width W, and the kth panel-distance, i.e., the volume height, $H_0+k\Delta H$.

FIG. 2 shows a partially folded container 2 in which a particular kth cooperating set of fold facilitating creases is chosen to form a desired volume $V_k$ for container 2. In order to form the folded container 2, a user selects the desired fold facilitating creases. Each set of cooperating fold facilitating creases may be marked with some sort of different identifiable marking such as color, or symbols, for example the X's shown as element 18. In this example, as seen in FIG. 2, container 2 is being folded to create the second volume $V_1$ (the first volume or the minimum volume being $V_0$). The side and end panels are folded at the second set of creases and the end panels folded at the second pair of hypotenuse creases.

To fold the container, one hand is preferably placed inside container 2, along one end panel 10 of the container, and just below the second fold facilitating crease. The other hand is placed along the outside of the same end panel 10 of container 2. The outside hand then presses inwardly and downwardly at the 90 degree angle of the second set of hypotenuse creases while the inside hand supports and guides the folding. Once the first end panel 10 has begun to fold, the other end panel 10 is folded in the same manner, resulting in a partially folded container. Either side panel, if there is no closure flap, for example one side panel 8, is then folded inwardly toward the other side panel 8, which is folded inwardly and downwardly toward the first-folded side panel 8 and also folded back on itself at the fold facilitating crease positioned ½W above the second fold facilitating crease, to lay partially underneath the first folded side panel 8, as shown in FIG. 2. Attached to side panel 8 is shown optional closure flap 16.

FIG. 3 shows container 2 in a final folded form, using optional closure flap 16 to secure container 2 in its folded form. It is important to note that when container 2 has been creased and folded to create a particular chosen volume, the container is substantially as strong and stable in volume as a box/container which does not incorporate the volume selectable features of the present container 2. In fact, when container 2 is used for less than the maximum volume, the container is stronger than conventional containers because of the overlapping at the top.

Figure 4:
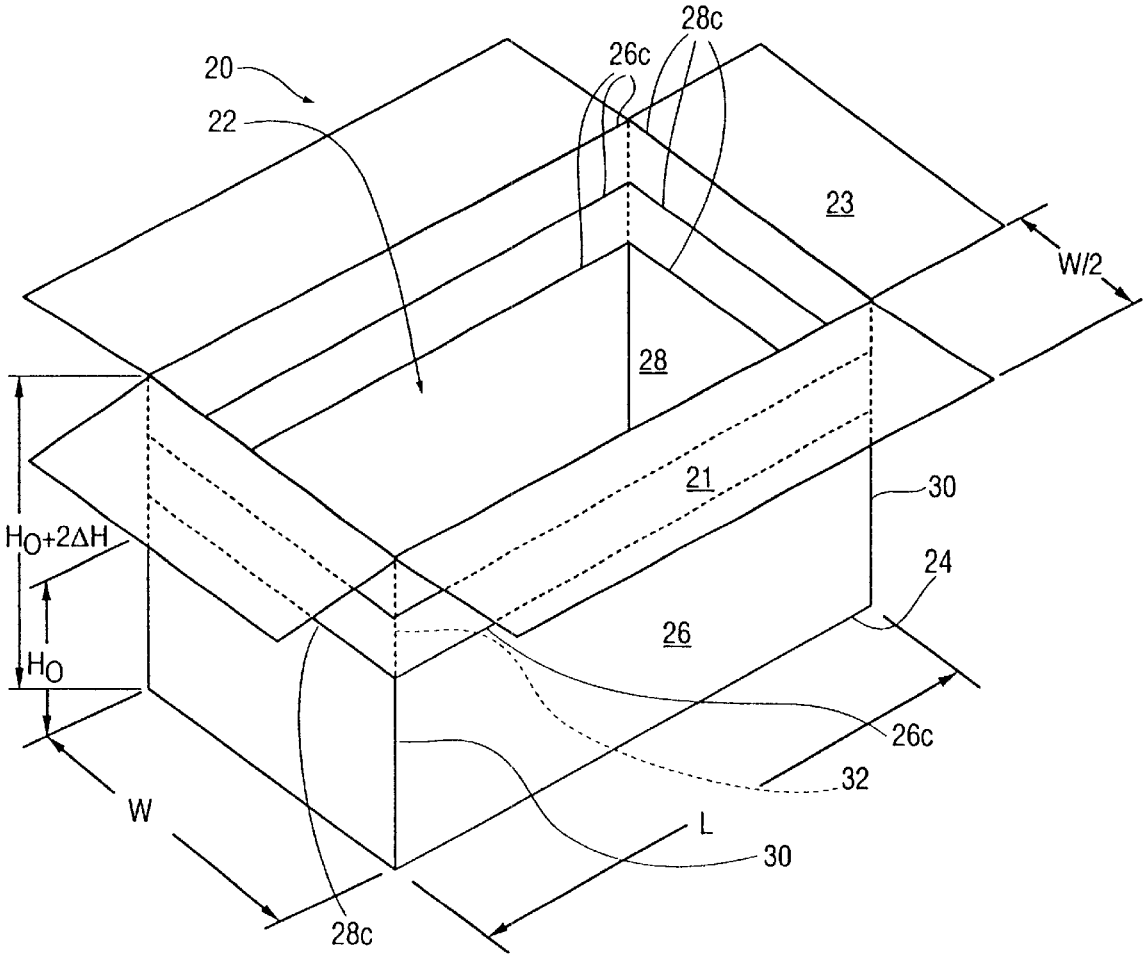
FIG. 4 shows a partially cut away perspective view of another embodiment of variable volume container having tearable perforations at each corner such that the corners may be torn downward at the perforations to a selected set of fold facilitating creases which when folded inwardly on the selected set of fold facilitating creases results in the desired volume container.
Figure 5:
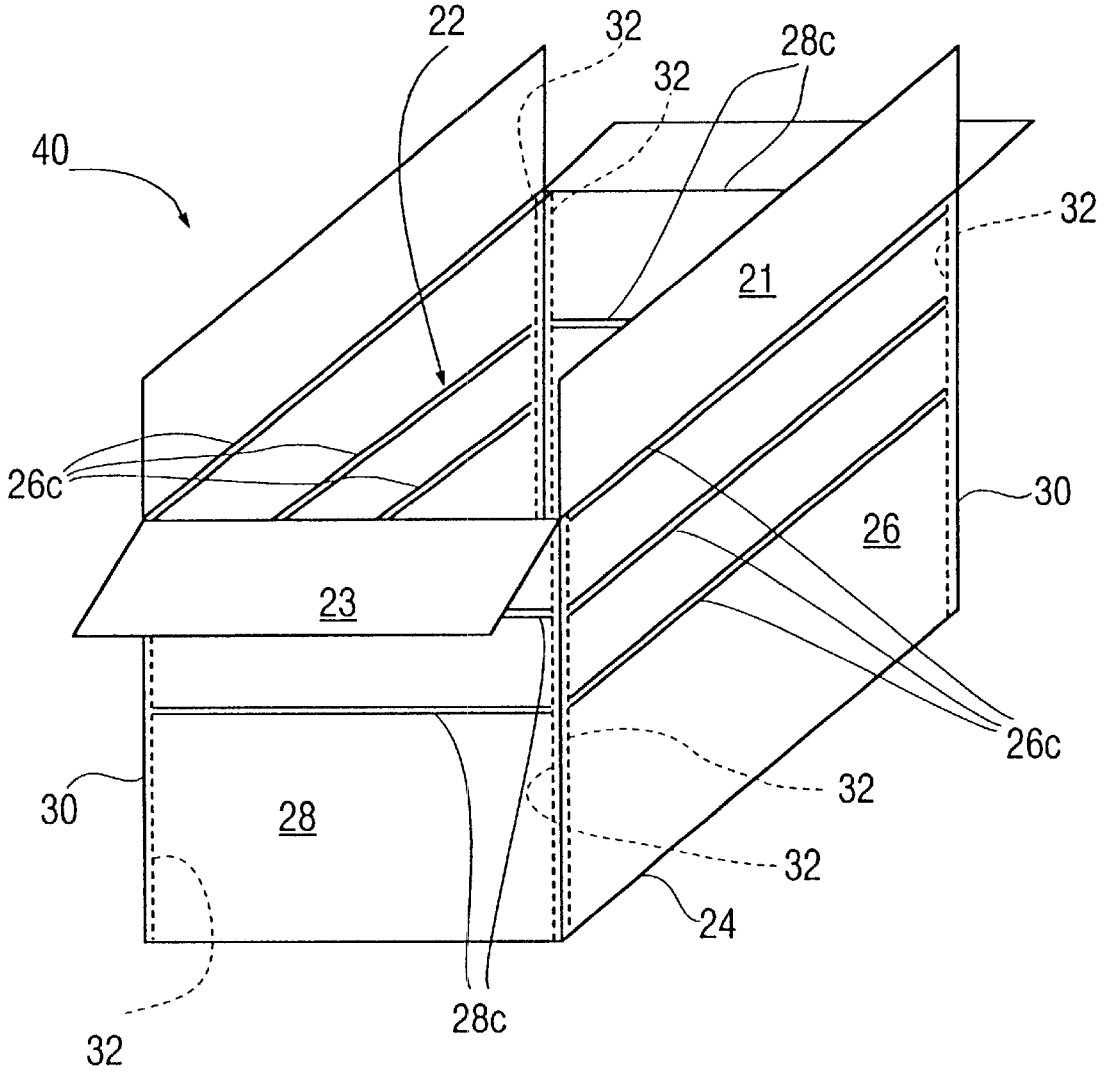
FIG. 5 shows a partially cut away perspective view of yet another embodiment of variable volume container having pairs of tearable perforations at each corner such that the corners may be torn downward at each of the pairs of perforations to a selected set of fold facilitating creases which when folded on the selected set of creases results in the desired volume container.

Another embodiment of the present invention is shown in FIGS. 4 and 5. Containers 20 and 40 each are shown having four (4) closure flaps, two (2) side panel flaps 21 and two (2) end panel flaps 23. The height dimension of the flaps, that is the distance from the top-most set of creases 26*c* and 28*c* to the top edge of the flaps is preferably not greater than ½ the width dimension W of either container 20 or container 40. This dimension limitation simply provides total closure of open top portion 22 when the maximum volume of the container is used. The maximum volume being obtained when the top-most creases are used for closing the flaps. There are generally a plurality (n) of sets of fold facilitating creases 26*c* and 28*c* on the side panels 26 and end panels 28. In each of FIG. 4 and FIG. 5, there is illustrated the particular number of sets being three (3). If the numeral n is used to represent the number of selectable volumes for container 20 or container 40, then in the FIGS. 4 and 5 illustrated container 20 and container 40 respectively, n would equal 3 (n=3). Thus there would be three (3) selectable volumes, each of the three being denoted by $V_k$, k being an integer chosen from 0, 1, . . . n−1. Thus the minimum volume is $V_k$=0 or $V_0$. The maximum volume is $V_k$=(n−1) or $V_{n-1}$. Thus for the case of n=3 the three selectable volumes are $V_0$, $V_1$ and $V_2$. Each of the selectable volumes would have a volume computed by the product of W times L times the sum of ($H_0$+kΔH). The sum ($H_0$+kΔH) may be considered as the volume height. Minimum height $H_0$ yields the minimum volume $V_0$. Incremental height ΔH is substantially the distance between sets of creases. Selection of the kth volume necessarily specifies the kth set of fold facilitating creases. Preferably for $V_0$, the 0th or the lower-most set of creases will be positioned down from opening 22 (e.g., down from the top edges of the flaps shown in FIGS. 4 and 5) by a distance of about container width W. Thus when flaps are created or increased in size by tearing down the perforations 32, which perforations 32 are located coincident with corners 30 for container 20 and which pairs of perforations 32 are spaced between about ⅛ inch to about ⅜ inch from corners 30 and parallel thereto for container 40, to the lower-most set of creases, the height of the flaps will be not more than container width W. However, even if the flap height is greater than W, that is the minimum volume is less, the excess flap material of the side flaps may be either cut off (or torn off if horizontally perforated) or if creases are provided the excess could easily be folded back over itself or under itself or folded over the opposite side and secured appropriately. Of course the underneath flap would have to be cut off (or torn off if horizontally perforated) or otherwise folded back over itself or under itself or tucked in.

Clearly, there may be theoretically any number of volumes but the number of volumes, i.e., the value of n will be a reasonable finite number such as an integer greater than one (1) but less than perhaps seven (7). Perforations 32, i.e., a means for permitting the tearing from at least between the top-most crease and the lower-most crease, is provided at the four corners 30 where side and end panels join for container 20 and is also provided on container 40, as pairs of perforations 32 each perforation 32 of the pairs of perforations being substantially parallel and spaced from corner 30 one perforation 32 of the pair being on sides 26 and the other on ends 28. It is also within the scope of the invention to have perforations which extend from bottom portion 24 which has a length of L and a width of W to open top 22 (with flaps omitted) of container 20 or container 40. Flaps would then be created by tearing down perforations 32 from open top 22 to the set of creases selected based upon the selected volume. The top-most set of creases would be a distance from open top 22 not less than ½ of W so as to permit complete closure of open top 22. However, in the event the distance from the top-most crease to the open top 22 is less than ½ W, a cover panel of sorts could be placed over open top 22 to cover the gap thereby created. H—the container height is the distance from the container bottom to the top edge of the created flap.

The method for making container 2 and for forming a selected volume for container 2 comprises the steps of taking an unassembled (or an assembled) corrugated cardboard box (other foldable and creasable material may be used) and while in the flat unassembled form, sets of cooperating fold facilitating creases could be put onto the side and the end panels, these creases being substantially parallel to the bottom edges of the panels. Additionally, the hypotenuse creases and the perpendicular crease on each end panel could be "scribed" onto the end panels all done before the container is assembled or formed. When the container is to be used it would be assembled from the flat form. The particular volume desired is determined and the appropriate set of cooperating creases is used to create the desired volume. The different possible volumes would be determined by the change in the height dimension H given that the container will have a specific length L and width W. The desired volume is selected and the set of cooperating creases, the substantially parallel creases on the side panels and the end panels, and the cooperating hypotenuse creases i.e., the cooperating hypotenuse crease pair on each end panel and the perpendicular crease on each end panel, are appropriately folded resulting in a closed container having the selected volume.

For the embodiment of container 20, having means for facilitating tearing (such as perforations) along the four container corners 30 from the open top 22 to the selected kth crease, the method comprises perforating at the four corners, tearing to the kth crease and causing folding along the kth creases thereby cooperatively closing the open top and enclosing within container 20 a volume $V_k$. The volume $V_k$ would equal length L times width W times the kth panel-distance (the variable height H distance).

For the embodiment of container 40, having means for facilitating tearing (such as perforations) along the four container corners 30 from the open top 22 to the selected kth crease, the method comprises perforating at the four corners with pairs of perforations 32 between about ⅛ inch and about ⅜ inch from each of corners 30 and paralleling corners 30, tearing to the kth crease and causing folding along the kth creases thereby cooperatively closing the open top and enclosing within container 40 a volume $V_k$. The volume $V_k$ would equal length L times width W times the kth panel-distance (the variable height H distance).

With either method of creating a container of selected volume, there could also be a closure flap attached to the top edge of one of the two side panels in either the embodiment of container 2 or container 20 or container 40. There would then be an additional method step after the container is closed wherein the closure flap would be secured to permit or assure an overlap when the container has the maximum volume $V_{n-1}$. It is also possible to use the closure flap to cover a gap left if the container were formed at the nth fold facilitating creases such that none of the panels would meet.

Although not shown, the present invention could also be embodied in a kit for forming a container of selectable variable volume comprising an unmarked container blank, means for marking the container blank, instructions for marking the container blank such that a container of discrete variable volume is made by folding the container blank according to markings or fold facilitating creases made following the instructions, and possibly lengths of precut tape to secure the folded container in a particular discrete volume. The means for marking which might be included in the kit could be a knife edge such as a knife or razor blade, wherein markings would be cut into the container blank, or simply a hard straight edge wherein markings or creases would be pressed into the container blank. The kit could also include a template and/or stencil for drawing or otherwise marking fold facilitating creases and possibly the template would have hard, straight edges of appropriate, differing lengths. The container blank would be cut or creased according to the instructions, thereby forming lines, scorings, cuts, or creases such that the container blank would be foldable along the cut or creased lines, into a container of a particular volume. Thus such a kit may include, along with the container blank, tape or tape and templates or templates alone. Any combination of elements could be considered as a kit.

The marking may comprise cutting into the container blank according to the instructions, thereby forming cut or score lines such that the container blank may be folded along the cut or score lines, into a container of a particular volume. The marking may also comprise pressing creases into the container blank according to the instructions, thereby forming crease, or fold lines, wherein the material of the container is not actually cut or pierced, such that the container blank may be folded along the crease or fold lines into a container of particular volume. Additionally the marking may comprise tearably perforating the container blank according to the instructions such that the container blank may be torn to an appropriate height and then folded into a container of a particular volume.

Also not shown are variations of both creased container 2 and perforated container 20. It is possible to have a container with a combination of both creases and perforations. It is also within the scope of the invention to provide for cooperating sets of creases and/or perforations extending downwards from the top portion as previously described, but also extending upwards from the bottom portion to give even more flexibility in selecting a volume size. For example, there could be a container similar to container 2 wherein the bottom would not be already sealed, and wherein the container would have creases towards the top portion like container 2, and perforations towards the bottom portion, such that the bottom could be torn to the desired distance, then sealed and then the top folded, thus adding to the number of possible volumes provided by the container. There could of course be containers combining two groups of creases, top and bottom, or two groups of perforations, top and bottom.

In another embodiment there could be included possibly, but not necessarily, pre-attached padding as an additional element of the present invention, wherein padding is attached to the container. Also possible is molded foam padding, preferably with inter-meshing raised and lowered portions. The inter-meshing portions are desirable so that when shipped empty in quantity and stored, the unassembled containers would take up as little space as possible, yet when assembled would provide protection for the items shipped. In this way also, time and expense would be saved by a customer trying to safely pack and ship a delicate item. The appropriate padding would be included with the container. Padding could be pre-attached or simply included loose as part of a kit.

Figure 6:
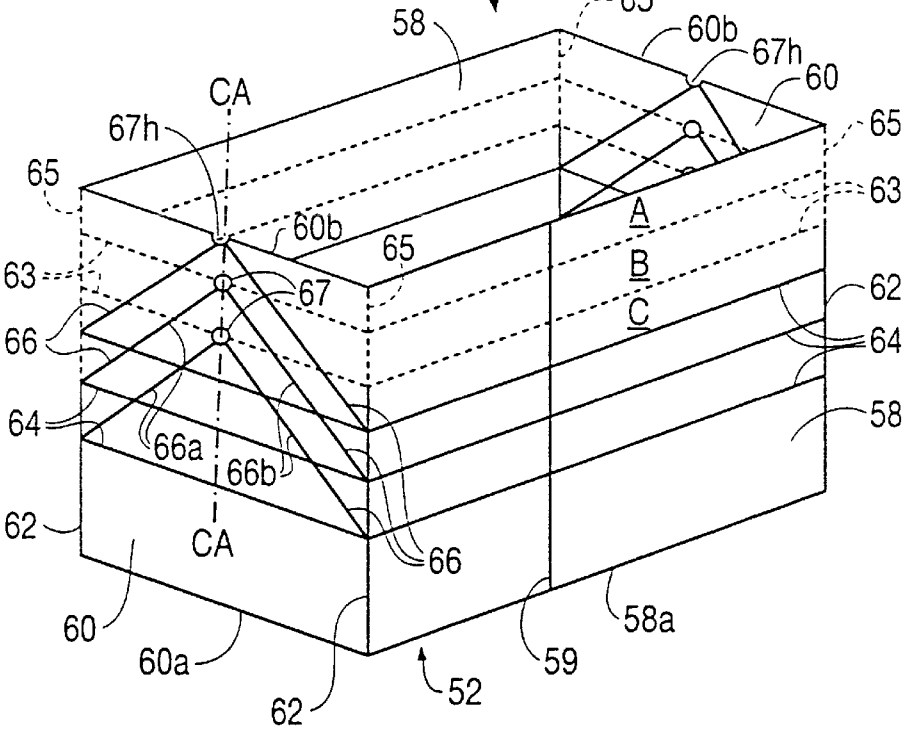
FIG. 6 shows a perspective view of still another embodiment of the variable volume container in accordance with the present invention.

FIG. 6 shows still another embodiment of a container 50 having various selectable volumes in accordance with the present invention which is somewhat similar to the embodiment of FIG. 1 where the volume of the container 50 can be easily changed. As generally known in the art of containers, the container 50 includes a bottom portion 52 having a substantially rectangular shape with two substantially parallel side edges 58*a* (only one shown) and two substantially parallel end edges 60*a* (only one shown). Two side panels 58 are attached to and extend upwardly from the two side edges 58*a* of the bottom portion 52, and two end panels 60 are attached to and extend upwardly from the two end edges 60*a* of the bottom portion 52. As can be readily appreciated, each of the two side panels 58 have edges which are attached to edges of each of the two end panels 60 to thereby form four corner edges 62 of the container 50. In addition, because the containers of the type described herein are frequently manufactured from a flat container blank (not shown), the side panels 58 and the end panels 60 are often made from a single panel which is folded into a rectangular shape and glued or otherwise affixed along a vertical overlapping seam 59. Of course, it is not mandatory for the vertical overlapping seam 59 to be in the position shown on the container 50 and in other embodiments, it may be positioned elsewhere.

The container 50 in accordance with the preferred embodiment of the present invention also includes a plurality of lateral perforations 63 that laterally extend substantially across the two side panels 58 and the two end panels 60 to allow selective removal of at least a portion of these panels. In this regard, various portions of these panels which are defined by the plurality of lateral perforations 63 have been marked as "A", "B" and "C" in the illustrated container 50 to clearly show the use of the present invention with respect to the configurations shown in the other figures. In addition, the container 50 of the present embodiment is also provided with a vertical perforation 65 on each of the four corner edges 62 to facilitate the removal of a portion of the two side panels 58 and the two end panels 60, i.e. to facilitate removal of the portions "A" and "B" from these panels.

Figure 7A:
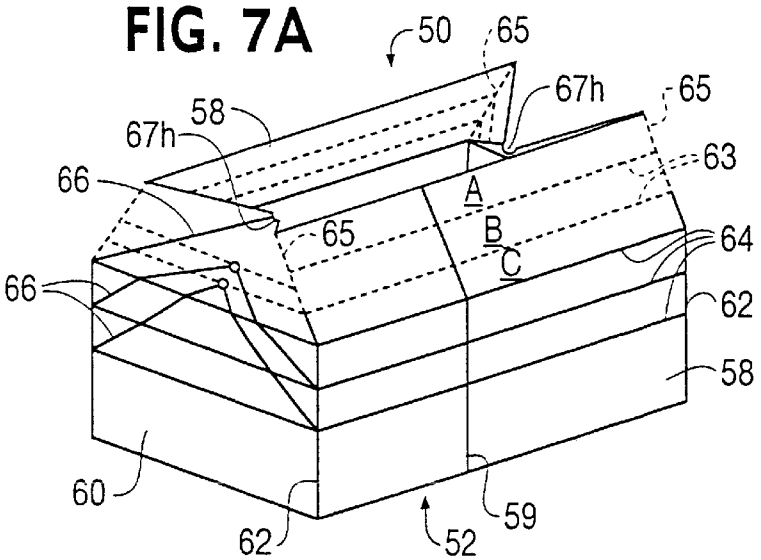
FIGS. 7A and 7B each show a perspective view of the variable volume container of FIG. 6 being folded into a maximum volume configuration.
Figure 7B:
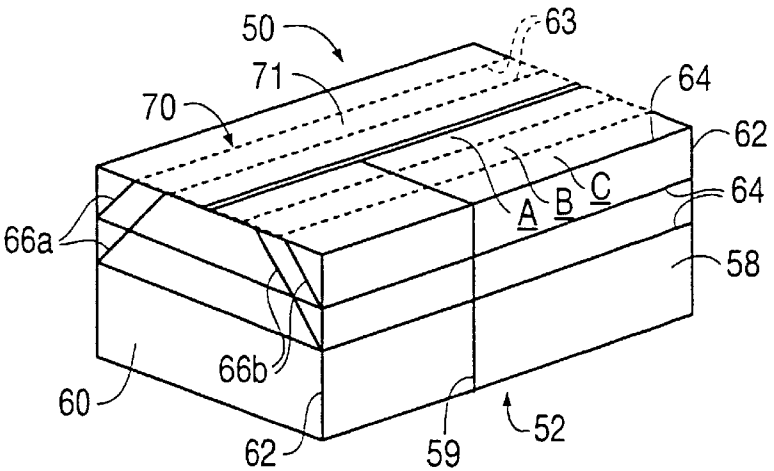

As can also be seen, each of the two end panels 60 include a plurality of sets of hypotenuse creases 66 which are adapted to allow selective inward folding of the two side panels 58 and the two end panels 60 in a manner further described in detail below to thereby form a top closure (as shown in FIG. 7B) for the container 50 which has a substantially flat top surface (as shown in FIG. 7B). As will be explained below, the hypotenuse creases 66, in conjunction with the lateral perforations 63 allow a user to select the desired volume of the container 50. In the illustrated embodiment, three hypotenuse creases 66 are provided on the two end panels 60 thereby providing a container 50 having three different selectable volumes. However, it should be apparent that a different number of hypotenuse creases 66 may be provided in other embodiments to thereby provide a container 50 having a different number of selectable volumes.

In accordance with the illustrated embodiment of FIG. 6, the container 50 further includes a plurality of fold facilitating creases 64 that also laterally extend substantially across the two side panels 58 and the two end panels 60 in a substantially continuous manner. Of course, it should be appreciated that whereas in the illustrated embodiment of FIG. 6, only three fold facilitating creases 64 are shown, other embodiments of the present invention may be provided with a different number of fold facilitating creases as well. Preferably, these plurality of fold facilitating creases 64 are positioned on the two side panels 58 and the two end panels 60 at a height distance less than that of the plurality of lateral perforations 63 in the manner shown. These fold facilitating creases 64 allow selective inward folding of the two end panels 60 as well as the two side panels 58 to thereby provide a top closure for the container 50 formed by a portion of the two side panels 58 as described herein below.

As can also be seen in FIG. 6, each of the plurality of sets of hypotenuse creases 66 preferably include a first crease 66a and a second crease 66*b*, each of the first crease 66*a* and the second crease 66*b* extending upwardly from a corner edge 62 of the container 50 in the manner shown. More specifically, in the preferred embodiment, the first crease 66*a* and the second crease 66*b* extend upwardly from an intersection of the corner edge 62 and a fold facilitating crease 64, and terminate at an intersection with a perforation 63 as shown. In this regard, the first crease 66*a* and the second crease 66*b* of each of the plurality of sets of hypotenuse creases 66 extend upwardly toward a central axis CA of the end panel 60 and terminate at an intersection thereof. It should be noted, however, that in other embodiments, the hypotenuse creases 66 may extend upwardly toward an axis which need not be centrally positioned like the central axis CA.

Thus, in the illustrated embodiment, the lower hypotenuse crease 66 (hypotenuse crease closest to the bottom portion 52) extends upwardly from the intersection of the corner edge 62 and the lower fold facilitating crease 64 (fold facilitating crease 64 closest to the bottom portion 52), and terminates at the intersection with the lower perforation 63 (perforation 63 closest to the bottom portion 52). Similarly, the middle hypotenuse crease 66 (hypotenuse crease between the other hypotenuse creases) extends upwardly from the intersection of the corner edge 62 and the middle fold facilitating crease 64 (fold facilitating crease between the other fold facilitating creases), and terminates at the intersection with the upper perforation 63 (perforation above the lower perforation). In a like manner, the upper hypotenuse crease 66 (hypotenuse crease furthest from the bottom portion 52) extends upwardly from the intersection of the corner edge 62 and the upper fold facilitating crease 64 (fold facilitating crease furthest from the bottom portion 52), and terminates at the intersection with the upper edge 60*b* of the two end panels 60. Moreover, in the illustrated embodiment, through-holes 67 and a half hole 67*h* are provided at this intersection with the perforation 63 and/or central axis CA where the first hypotenuse creases 66*a* and the second hypotenuse creases 66*b* terminate to thereby facilitate folding of the container 50 in the manner discussed further below. It is important to note that the above illustrates only one embodiment of the present invention where the container 50 is adapted to be configurable into three selectable volumes: a maximum volume, an intermediate volume, and a minimum volume. In other embodiments of the present invention however, different numbers of lateral perforations 63, fold facilitating creases 64, and/or hypotenuse creases 66 may be provided to provide a container 50 having different numbers of selectable volumes.

As previously noted, the vertical overlapping seam 59 of FIG. 6 need not be positioned in the manner shown but instead, may be provided elsewhere on the container 50. In addition, it should also be apparent that because the vertical overlapping seam 59 is defined by two panel portions which overlap, this portion of the container 50 is thicker than the remainder of the container 50. Thus, there may be added shear stresses which tend to separate the overlapped portions when it is folded, or if the outer panel is perforated, the outer panel that overlaps the inner panel may split. To mitigate this tendency, in the preferred embodiment, a cutaway is provided on the inner panel portion while the outer panel portion is provided with the fold facilitating crease 64. Furthermore, whereas in the present illustrated embodiment of FIG. 6, the plurality fold facilitating creases 64 and the hypotenuse creases 66 are merely folds, in other embodiments, they may also be formed of fold facilitating perforations instead of, or in addition to, the folds. Thus, the term "creases" should be understood more broadly to mean creases, perforations or a combination thereof.

Moreover, whereas in the above discussed embodiment, lateral perforations 63 are provided on the two side panels 58 and two end panels 60 for removing the desired portions thereof, in alternative embodiments, other separating means such as removable strips (not shown) may be provided instead. In such an embodiment, the removable strips would be embedded and/or attached to the two side panels 58 and two end panels 60 in positions of the lateral perforations so that the user can grab and pull on the strips thereby separating the portions of these panels and allowing removal thereof. However, the provisions of lateral perforations is preferred since the removal of the desired portions of the two side panels 58 and the two end panels 60 can be performed more neatly than would be possible with such removable strips. Moreover, the provisions of lateral perforations 63 would also be easier to manufacture thereby making the container 50 with lateral perforations 63 more economical than with such removable strips.

FIGS. 7A and 7B each show a perspective view of the variable volume container 50 of FIG. 6 being folded into a maximum volume configuration. As can be seen in FIG. 7A, the two end panels 60 are initially inwardly folded along a desired hypotenuse crease 66 (in this case, the upper hypotenuse crease) to thereby cause inward folding of the side panels 58 along a desired fold facilitating crease 64 (in this case, the upper fold facilitating crease). With the continued inward folding of the side panels 58 along the upper fold facilitating crease 64, a top closure 70 as shown in FIG. 7B is formed by portions of the side panels 58 and the end panels 60. In addition, as can be clearly seen, the top closure 70 of this embodiment has a substantially flat top surface 71 to thereby avoid disadvantages of other known prior art containers and the like by allowing multiple containers to be stacked on top of each other. It should be noted that in the configuration shown in FIG. 7B, the variable volume container 50 has a maximum volume configuration since no parts of the two side panels 58 or the two end panels 60 were removed using the lateral perforations 63 and the end panels 60 were inwardly folded along the upper hypotenuse crease 66. This is most clearly shown in FIG. 7B by the portions of the side panel 58 marked "A", "B" and "C" which now form the top closure 70 and indicates no portion of the two side panels 58 or the two end panels 60 were removed. However, as will be discussed herein below, the container may be configured to have various volumes less than the maximum volume as well.

Figure 8A:
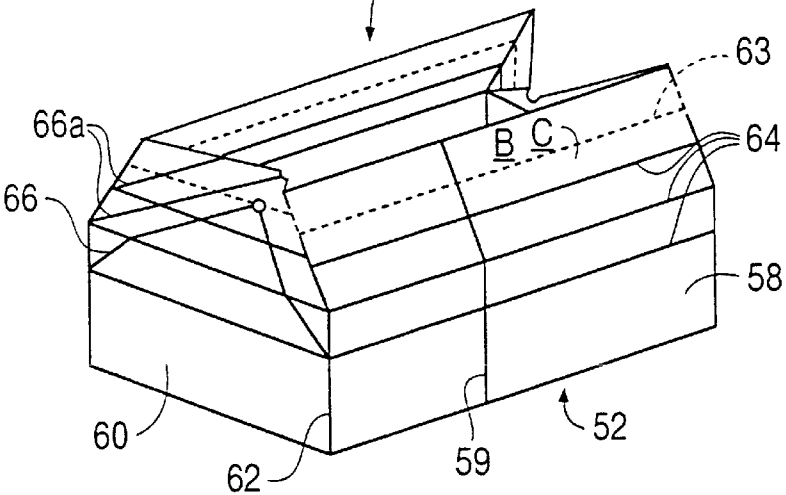
FIGS. 8A and 8B each show a perspective view of the variable volume container of FIG. 6 being folded into an intermediate volume configuration.
Figure 8B:
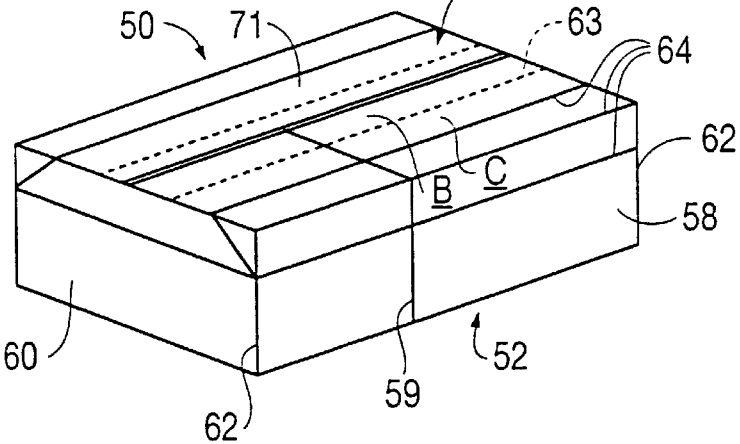

FIGS. 8A and 8B each show a perspective view of the variable volume container 50 of FIG. 6 being folded into an intermediate volume configuration. As can be seen, a portion of the two side panels 58 and the two end panels 60 which was marked "A" has been removed via the upper perforation 63. The container 50 with a portion of the two side panels 58 and the two end panels 60 removed is folded in a similar manner to the configuration described above relative to FIGS. 7A and 7B to thereby provide a container 50 having an intermediate volume. In particular, the two end panels 60 are inwardly folded along the middle hypotenuse crease 66 to thereby cause inward folding of the two side panels 58 along the middle fold facilitating crease 64. With the continued inward folding of the side panels 58 along the middle fold facilitating crease 64, the top closure 70 as shown in FIG. 8B is formed by portions of the side panels 58 and the end panels 60, the top closure 70 having a substantially flat surface 71. As can be clearly seen in FIG. 8B, the variable volume container 50 has a intermediate volume configuration since a portion of the two side panels 58 and the two end panels 60 were removed using the lateral perforations 63, and the end panels 60 were inwardly folded along the middle hypotenuse crease 66. This is most clearly shown by the portions of the side panel 58 that are marked "B" and "C" which partially form the top closure 70, the portion marked "A" having been removed.

Figure 9A:
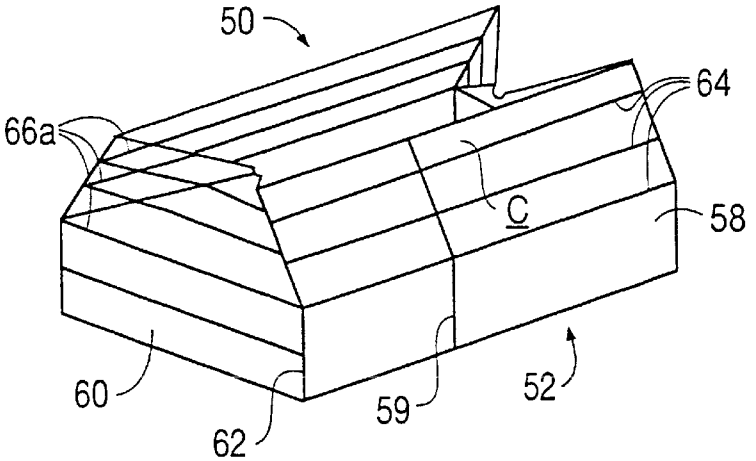
FIGS. 9A and 9B each show a perspective view of the variable volume container of FIG. 6 being folded into a minimum volume configuration.
Figure 9B:
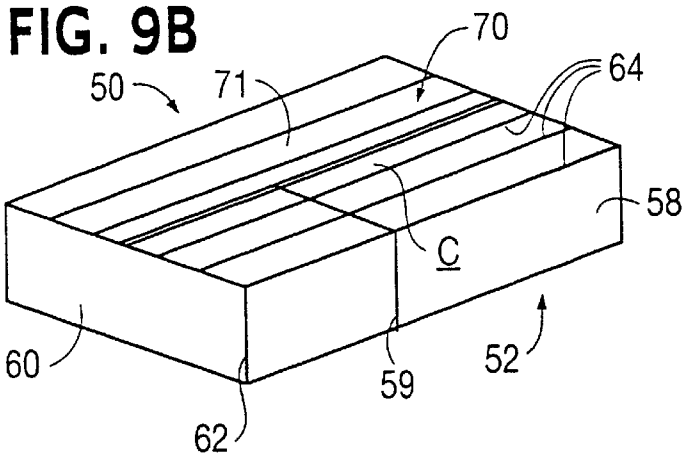

FIGS. 9A and 9B each show a perspective view of the variable volume container 50 of FIG. 6 being folded into a minimum volume configuration. As can be seen, portions of the side panel 58 and the end panel 60 which were marked "A" and "B" have been removed via the lower perforation 63. The two end panels 60 are then inwardly folded along the lower hypotenuse crease 66 to thereby cause inward folding of the side panels 58 along the lower fold facilitating crease 64. With the continued inward folding of the side panels 58 along the lower fold facilitating crease 64, the top closure 70 as shown in FIG. 9B is formed by portions of the side panels 58 and the end panels 60, the top closure 70 having a substantially flat surface 71. As can be clearly seen in FIG. 9B, the variable volume container 50 has a minimum volume configuration since portions of the two side panels 58 and the end panels 60 were removed using the lower lateral perforations 63 and the end panels 60 were inwardly folded along the lower hypotenuse crease 66. This is most clearly illustrated in FIG. 9B which shows the portion of the side panel 58 marked "C" that partially forms the top closure 70, the portions marked "A" and "B" having been removed. Again, it should be noted that the above illustrates only one embodiment where the container 50 is adapted to be configurable into three selectable volumes. In other embodiments of the present invention, different numbers of lateral perforations 63, fold facilitating creases 64, and/or hypotenuse creases 66 may be provided.

Figure 10:
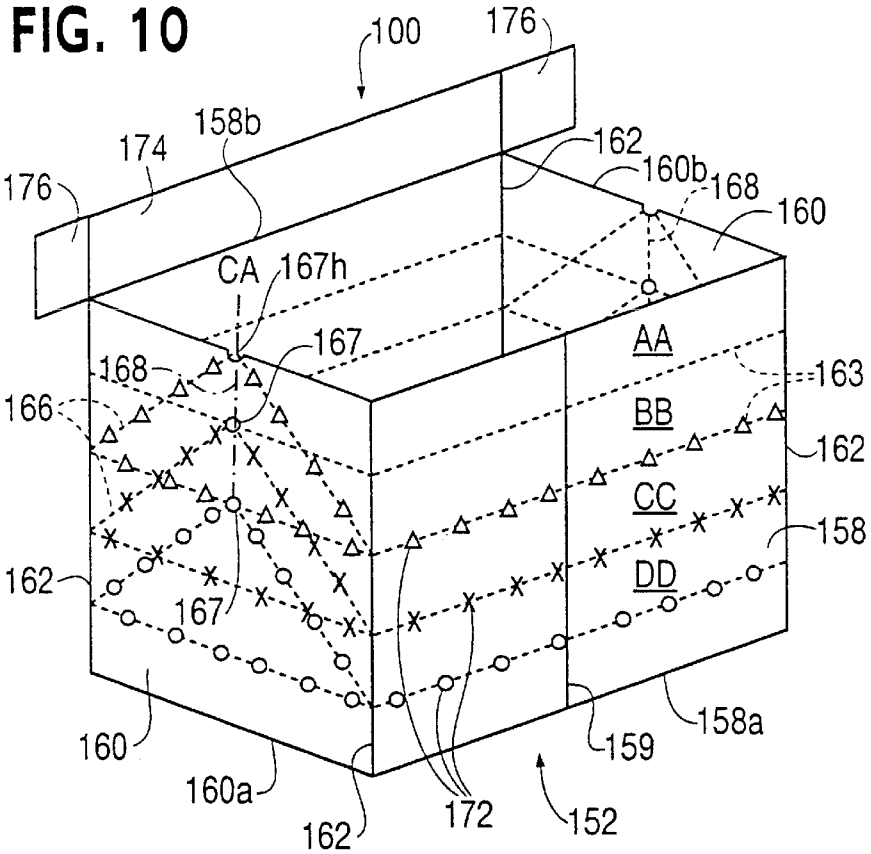
FIG. 10 shows an enlarged view of yet another embodiment of the variable volume container in accordance with the present invention.

FIG. 10 shows an enlarged view of yet another embodiment of the variable volume container 100 in accordance with the present invention similar to the embodiment of FIG. 6 where the volume of the container 100 can be easily changed. Like the previous embodiment, the container 100 includes a bottom portion 152 having a substantially rectangular shape with two substantially parallel side edges 158*a* (only one shown) and two substantially parallel end edges 160*a* (only one shown). Two side panels 158 are attached to and extend upwardly from the two side edges 158*a* of the bottom portion 152, and two end panels 160 are attached to and extend upwardly from the two end edges 160*a* of the bottom portion 152. As can be readily appreciated, each of the two side panels 158 have edges which are attached to edges of each of the two end panels 160 to thereby form four corner edges 162 of the container 100. In addition, the container 100 is preferably manufactured from a flat container blank (not shown) so that side panels 158 and end panels 160 are affixed along a vertical overlapping seam 159 although not necessarily in the location shown. Furthermore, one of the side panels 158 is provided with an optional closure flap 174 at an upper edge 158*b*, the use of which will be explained in further detail below, the closure flap 174 also including side flaps 176 as shown.

Also like the previous embodiment, the container 100 also includes a plurality of lateral perforations 163 that laterally extend substantially across the two side panels 158 and the two end panels 160. These lateral perforations 163 allow selective removal of at least a portion of these panels which have been marked as AA, BB, CC and DD in the illustrated drawings of FIGS. 10 to 13B in the manner previously discussed. Of course, these markings are merely provided on these figures to clarify the discussion of the present invention and need not be actually provided on the container 100. Unlike the previously discussed embodiment of FIG. 6 however, the embodiment of FIG. 10 does not include any fold facilitating creases. Instead, the plurality of lateral perforations 163 of the container 100 serve a similar function in the present embodiment as the fold facilitating creases of the previous embodiment so that these lateral perforations 163 may be used to allow folding of the two side panels 158 and the two end panels 160.

As can also be seen in FIG. 10, each of the two end panels 160 include a plurality of sets of hypotenuse creases 166 which in the present illustrated embodiment, are also optionally formed as perforations. It should be noted however, that the hypotenuse creases 166 need not be perforations in other embodiments and thus, the terms hypotenuse creases should be understood to mean conventional creases as shown in FIGS. 6 to 8B, or perforated hypotenuse creases as shown in FIGS. 10 to 13B. The plurality of hypotenuse creases 166 of FIG. 10 extends upwardly from an intersection of a corner edge 162 and a perforation 163, and terminates at an intersection with another perforation 163 in the manner shown. It should be noted that while in this embodiment, like the previous embodiment, the plurality of sets of hypotenuse creases 166 extends upwardly toward a central axis CA of the end panel 160 and terminates at an intersection thereof, in other embodiments, the hypotenuse creases 166 may extend upwardly toward an axis which need not be centrally positioned like the central axis CA. Further details of the plurality of sets of hypotenuse creases 166 are similar to those of the previous embodiment of FIG. 6 and should be apparent from careful review of FIG. 10. Consequently, such details are omitted here to avoid repetition. Moreover, also like the previous embodiment, the illustrated embodiment of the container 100 in FIG. 10 is adapted to be configurable into three selectable volumes: a maximum volume, an intermediate volume, and a minimum volume. Consequently, the two end panels 160 are provided with three sets of hypotenuse creases 166. However, in other embodiments, different numbers of hypotenuse creases 166 and/or lateral perforations 163 may be provided to thereby provide a container 100 having different numbers of selectable volumes.

In addition, in the illustrated embodiment of the present invention in FIG. 10, the container 100 is also provided with through-holes 167 and half hole 167*h* at the intersection of the hypotenuse creases 166 with the perforation 163 and/or central axis CA where the hypotenuse creases 166 terminate. Furthermore, vertical perforations 168 are also provided extending between the through-holes 167 and up to the upper edge 160*b* of the two end panels 160. These through-holes 167 and the vertical perforations 168 facilitate folding of the container 100 in the manner discussed in more detail herein below.

Moreover, as can be seen, one or more of the lateral perforations 163 of the container 100 may be provided with identifiable markings 172. In the embodiment shown, the identifiable markings 172 are in the form of "0", "X" and "Δ" that are printed on the respective lateral perforations 163 as well as on the corresponding hypotenuse creases 166 (which are also perforated) that can be used in conjunction with the lateral perforations 163 to change the volume of the container 100 in accordance with the present invention. As can also be seen, the upper lateral perforation is unmarked to thereby simplify the figure. It should also be noted that these identifiable markings 172 are optionally provided and may take on other forms as well, for example a color code or other symbols as well such as "+" etc. These identifiable markings 172, if provided, facilitate proper assembly of a container 100 having a desired volume. In particular, identifiable markings "0" identify the lateral perforations 163 and the corresponding hypotenuse creases 166 on the two end panels 160 which should be used in the manner described below to provide a container 100 having a minimum volume. Likewise, the identifiable markings "X" identify the lateral perforations 163 and the corresponding hypotenuse creases 166 on the two end panels 160 which should be used to provide a container 100 having an intermediate volume. Lastly, the identifiable markings "Δ" identify the lateral perforations 163 and the corresponding hypotenuse creases 166 on the two end panels 160 which should be used to provide a container 100 having a maximum volume. As will be evident from the discussion herein below, these markings, if provided, greatly facilitate the proper assembly of the container 100 into a configuration having the desired volume.

As previously noted, the vertical overlapping seam 59 of FIG. 6 need not be positioned in the manner shown but instead, may be provided elsewhere on the container 50. In addition, it should also be noted that although the plurality of fold facilitating creases are in the form of lateral perforations 163 in the present embodiment, like the embodiment of FIG. 6, because the vertical overlapping seam 159 is defined by two panel portions which overlap, a cutaway is provided on the inner panel portion while the outer panel portion is provided with a solid fold facilitating crease instead of a perforated portion. Again, this mitigates the tendency for the two panel portions to become separated when the overlapped portions are folded or splitting of the outer panel. Furthermore, whereas in the above discussed embodiment, lateral perforations 163 are provided on the two side panels 158 and two end panels 160, in alternative embodiments, other means such as removable strips (not shown) discussed previously may be provided instead.

Figure 11A:
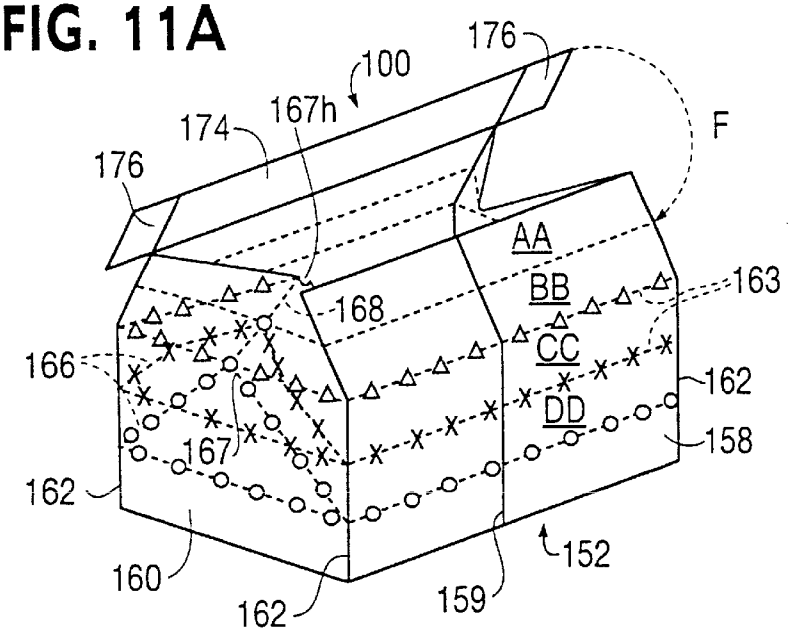
FIGS. 11A and 11B each show a perspective view of the variable volume container of FIG. 10 being folded into a maximum volume configuration.
Figure 11B:
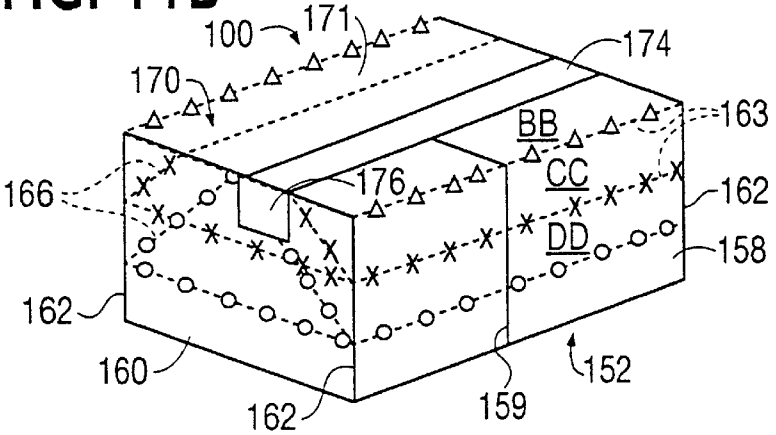

FIGS. 11A and 11B each show a perspective view of the variable volume container 100 of FIG. 10 being folded into a maximum volume configuration. As can be seen in FIG. 11A, the two end panels 160 are inwardly folded along a desired hypotenuse crease 166, which in this case, is marked by "Δ". This causes inward folding of the side panels 158 along a desired perforation 163, which in this case, is also marked by "Δ" and intersects the hypotenuse crease marked by "Δ" at the corner edge 162. The side panel 158 with the closure flap 174 is inwardly folded along arrow F so that the closure flap 174 overlaps the other side panel 158. With the continued inward folding of the side panels 158 along the perforation marked by "Δ", a top closure 170 as shown in FIG. 11B is formed by portions of the two side panels 158 and the two end panels 160, the top closure 170 having a substantially flat top surface 171. As can be seen, the closure flap 174 overlaps a part of the portion of the side panel 158 which forms the top closure 170. In addition, the side flaps 176 can be downwardly folded toward the end panels 160 in the manner shown in FIG. 11B. The closure flap 174 and the side flaps 176 can then be secured by tape or other adhesive means and provide superior coverage and protection of the contents placed within the container 100 by covering any openings present on the top closure 170.

In regards to providing a container having an intermediate or minimum volume, it should be apparent to one skilled in the art that the container 100 shown in FIG. 10 can be used in a similar manner to the previously discussed embodiment in FIGS. 6 to 9B to thereby configure the container 100 to have varying volumes. In particular, because the container 100 is provided with a plurality of lateral perforations 163, portions marked AA of the two side panels 158 and the two end panels 160 can be removed (together with the closure flap 174 and the side flaps 176) using the unmarked lateral perforations 163 accessed via vertical perforations. The two end panels 160 can then be inwardly folded along the hypotenuse creases 166 marked with "X" and the two side panels 158 can also be inwardly folded along the lateral perforations also marked with "X" in the manner described previously relative to FIGS. 8A and 8B to thereby provide a container 100 having an intermediate volume. Likewise, portions marked AA and BB of the two side panels 158 and the two end panels 160 can be removed (together with the closure flap 174 and the side flaps 176) using the lateral perforations 160 marked by "Δ". Then, the two end panels 160 can be folded along the hypotenuse creases 166 marked with "0" and the two side panels 158 can also be inwardly folded along the lateral perforations also marked with "0" in the manner described previously relative to FIGS. 9A and 9B to thereby provide a container 100 having a minimum volume. Further details of such configuring of the container 100 are substantially similar to those of the container 50 described previously and thus, are omitted here to avoid repetition.

Figure 12A:
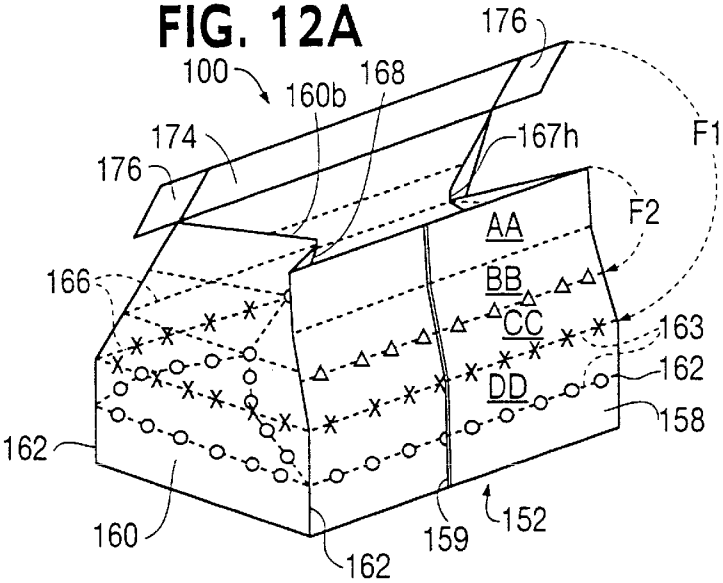
FIGS. 12A and 12B each show a perspective view of the variable volume container of FIG. 10 being folded into an intermediate volume configuration.
Figure 12B:
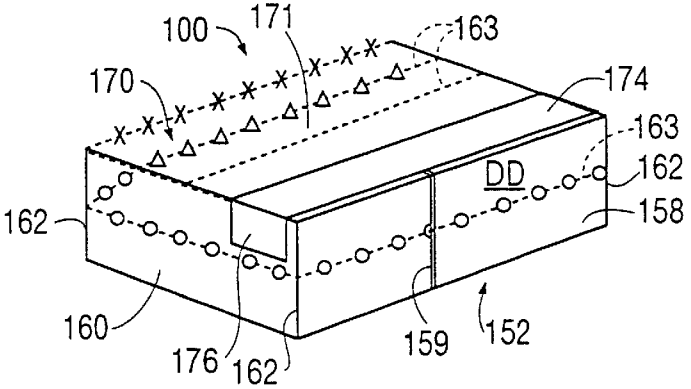

FIGS. 12A and 12B each show a perspective view of the variable volume container 100 of FIG. 10 being folded into an intermediate volume configuration where, in contrast with the discussion of the previous embodiment, no portion of the two side panels 158 or the end panels 160 are removed. In this regard, as can be clearly seen in FIG. 12A, the two end panels 160 are folded along the middle hypotenuse crease 166 which is marked by "X" and the two side panels 158 are also inwardly folded along the lateral perforations 163 marked by "X". The two side panels 158 are brought close together by further folding the two end panels 160 along the vertical perforation 168 near the upper edge 160*b*. It should be appreciated that when the two side panels 158 are brought close together, the upper portions AA of the two side panels 158 are in a substantially vertical orientation and thus, requires the two side panels 158 to be folded along yet another lateral perforation 163, in this case, the unmarked perforation closest to the upper edge 160*b*. At this point, the container 100 would have a configuration somewhat similar to the spout-forming containers such as milk cartons. Then the two side panels 158 are folded in the direction of arrows F1 and F2 shown. As can be appreciated and indicated by the folding direction indicated by arrow F2, one of the side panels 158 is actually folded inwardly and, then outwardly so that the upper portion AA actually overlaps and rests on top of portion BB of the same side panel. FIG. 12B also clearly shows how the closure flap 174 overlaps at least a part of the side panel and how the side flaps 176 can be downwardly folded toward the two end panels 160 of the container 100. In the above described manner, the container 100 having an intermediate volume as shown in FIG. 12B is provided without removing any portion of the container 100.

Figure 13A:
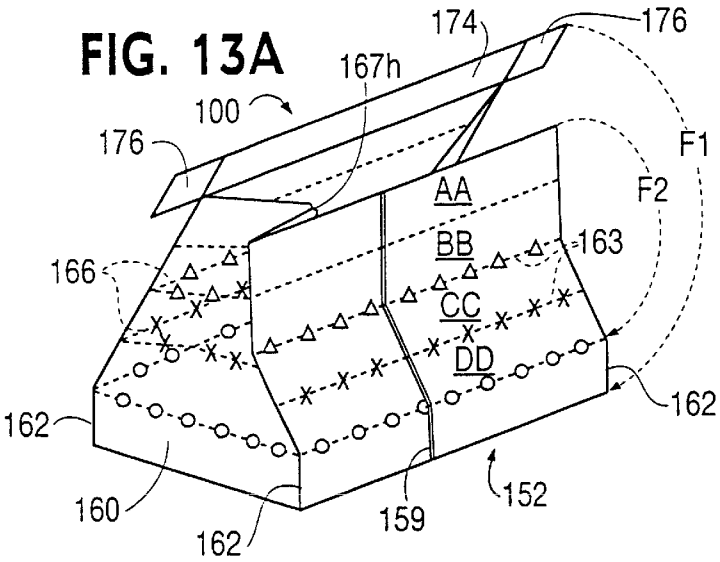
FIGS. 13A and 13B each show a perspective view of the variable volume container of FIG. 10 being folded into a minimum volume configuration.
Figure 13B:
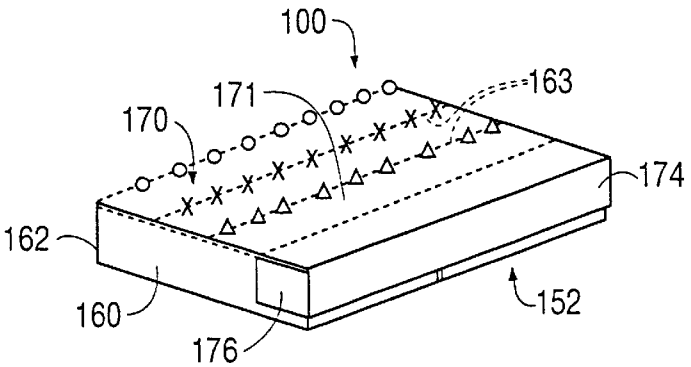

FIGS. 13A and 13B each show a perspective view of the variable volume container 100 of FIG. 10 being folded into a minimum volume configuration where no portion of the two side panels 158 or the end panels 160 are removed. In a similar manner to the discussion directed to FIGS. 12A and 12B, the two end panels 160 are folded along the lower hypotenuse crease 166 which is marked by "0" and the two side panels 158 are also folded along the lateral perforations 163 marked by "0". The two end panels 160 are further folded along the vertical perforation 168 above the hypotenuse crease marked by "0" toward the upper edge 160*b* so that the two side panels 158 can be brought close together. Again, this requires that the two side panels 158 to be folded along yet another lateral perforation 163, in this case, the perforation marked by "Δ" so that the container 100 would have a configuration somewhat similar to the spout-forming containers such as milk cartons. The two side panels 158 are then folded in the direction of arrows F1 and F2 to thereby form the container of FIG. 13B having a minimum volume with a top closure 170 having a substantially flat surface 171. It should again be appreciated that one of the side panels 158 is actually folded inwardly and, then outwardly so that portions AA and BB actually overlaps CC and DD portions of the same side panel. FIG. 13B also clearly shows how the closure flap 174 overlaps at least a part of a side panel and how the side flaps 176 can be downwardly folded toward the two end panels 160 of the container 100.

It is thought that the present CONTAINER HAVING A PLURALITY OF SELECTABLE VOLUMES, for use in the package shipping and mailing industry, and many of its attendant advantages is understood from the foregoing description and it will be apparent that various changes may be made in the form, construction and arrangement of the parts thereof without departing from the spirit and scope of the invention or sacrificing any of its material advantages, the forms hereinbefore described being not limiting but merely preferred or exemplary embodiments.

I claim:

1. A container having a plurality of selectable volumes comprising:

a bottom portion having a substantially rectangular shape with two substantially parallel side edges and two substantially parallel end edges;

two side panels attached to and extending upwardly from said two side edges of said bottom portion;

two end panels attached to and extending upwardly from said two end edges of said bottom portion, each of said two end panels having edges which are attached to edges of each of said two side panels to thereby form four corner edges of said container;

at least one line of perforations laterally extending substantially across said two side panels and said two end panels to allow at least one of folding and removal of at least a portion of said two side panels and said two end panels;

wherein each of said two end panels includes a plurality of sets of hypotenuse creases adapted to allow selective inward folding of said two end panels to thereby form a top closure for said container with a portion of said two side panels and to allow selection of a volume for said container, said plurality of sets of hypotenuse creases being nested on said two end panels, and extending upwardly toward a central axis of said two end panels, each of said plurality of sets of hypotenuse creases terminating at an intersection with said central axis.

2. The container having a plurality of selectable volumes of claim 1, wherein said at least one line of perforations is a plurality of lines of perforations laterally extending substantially across said two side panels and said two end panels.

3. The container having a plurality of selectable volumes of claim 2, wherein each of said plurality of sets of hypotenuse creases includes a first crease and a second crease, each of said first crease and said second crease extending upwardly from a corner edge of said container.

4. The container having a plurality of selectable volumes of claim 1, further including a closure flap at an upper edge of at least one of said two side panels for overlapping at least a part of the other of said two side panels.

5. The container having a plurality of selectable volumes of claim 4, further including side flaps attached to said closure flap, said side flaps being adapted to be downwardly folded toward said two end panels.

6. The container having a plurality of selectable volumes of claim 1, further including at least one fold facilitating crease laterally extending substantially across said two side panels and said two end panels to allow folding of said two side panels and said two end panels along said at least one fold facilitating crease.

7. The container having a plurality of selectable volumes of claim 6, further including a vertical overlapping seam defined by an outer panel portion and an inner panel portion which overlap, a cutaway being provided on said inner panel portion and said at least one fold facilitating crease extending along said outer panel portion.

8. The container having a plurality of selectable volumes of claim 6, wherein said at least one fold facilitating crease is a plurality of fold facilitating creases laterally extending substantially across said two side panels and said two end panels to allow selective folding of said two side panels and said two end panels.

9. The container having a plurality of selectable volumes of claim 8, wherein said at least one line of perforations is a plurality of lines of perforations laterally extending substantially across said two side panels and said two end panels to allow selective removal of said at least a portion of said two side panels and said two end panels.

10. A container having a plurality of selectable volumes comprising:

a bottom portion having a substantially rectangular shape with two substantially parallel side edges and two substantially parallel end edges;

two side panels attached to and extending upwardly from said two side edges of said bottom portion;

two end panels attached to and extending upwardly from said two end edges of said bottom portion, each of said two end panels having edges which are attached to edges of each of said two side panels to thereby form four corner edges of said container; and at least one line of perforations laterally extending substantially across said two side panels and said two end panels to allow at least one of folding and removal of at least a portion of said two side panels and said two end panels;

wherein each of said two end panels includes at least one set of hypotenuse creases adapted to allow said two end panels to be inwardly folded to thereby form a top closure for said container with a portion of said two side panels;

wherein said at least one line of perforations is a plurality of lines of perforations laterally extending substantially across said two side panels and said two end panels;

wherein said at least one set of hypotenuse creases on each of said two end panels is a plurality of sets of hypotenuse creases adapted to allow selective inward folding of said two side panels and said two end panels to thereby allow selection of a volume for said container;

wherein each of said plurality of sets of hypotenuse creases includes a first crease and a second crease, each of said first crease and said second crease extending upwardly from a corner edge of said container;

wherein said first crease and said second crease of each of said plurality of sets of hypotenuse creases extends upwardly toward a central axis of an end panel and terminates at an intersection thereof;

wherein said first crease and said second crease of each of said plurality of sets of hypotenuse creases extends upwardly and terminates at an intersection with a line of perforations; and wherein said central axis includes a vertical perforation extending between said plurality of lines of perforations.

11. The container having a plurality of selectable volumes comprising:

a bottom portion having a substantially rectangular shape with two substantially parallel side edges and two substantially parallel end edges;

two side panels attached to and extending upwardly from said two side edges of said bottom portion;

two end panels attached to and extending upwardly from said two end edges of said bottom portion, each of said two end panels having edges which are attached to edges of each of said two side panels to thereby form four corner edges of said container; and at least one line of perforations laterally extending substantially across said two side panels and said two end panels to allow at least one of folding and removal of at least a portion of said two side panels and said two end panels;

wherein each of said two end panels includes at least one set of hypotenuse creases adapted to allow said two end panels to be inwardly folded to thereby form a top closure for said container with a portion of said two side panels;

wherein said at least one line of perforations is a plurality of lines of perforations laterally extending substantially across said two side panels and said two end panels;

wherein said at least one set of hypotenuse creases on each of said two end panels is a plurality of sets of hypotenuse creases nested together which are adapted to allow selective inward folding of said two side panels and said two end panels to thereby allow selection of a volume for said container;

wherein each of said plurality of sets of hypotenuse creases includes a first crease and a second crease, each of said first crease and said second crease extending upwardly from a corner edge of said container; and wherein said first crease and said second crease of each of said plurality of sets of hypotenuse creases extends upwardly toward a central axis of said two end panels and terminates at an intersection with a line of perforations and said central axis of said two end panels.

12. The container having a plurality of selectable volumes of claim 11, wherein said first crease and said second crease of each of said plurality of sets of hypotenuse creases are perforated.

13. A container having a plurality of selectable volumes comprising:

a bottom portion having a substantially rectangular shape with two substantially parallel side edges and two substantially parallel end edges;

two side panels attached to and extending upwardly from said two side edges of said bottom portion;

two end panels attached to and extending upwardly from said two end edges of said bottom portion, each of said two end panels having edges which are attached to edges of each of said two side panels to thereby form four corner edges of said container; and at least one line of perforations laterally extending substantially across said two side panels and said two end panels to allow at least one of folding and removal of at least a portion of said two side panels and said two end panels;

wherein each of said two end panels includes at least one set of hypotenuse creases adapted to allow said two end panels to be inwardly folded to thereby form a top closure for said container with a portion of said two side panels;

wherein said at least one line of perforations is a plurality of lines of perforations laterally extending substantially across said two side panels and said two end panels;

wherein said at least one set of hypotenuse creases on each of said two end panels is a plurality of sets of hypotenuse creases nested together which are adapted to allow selective inward folding of said two side panels and said two end panels to thereby allow selection of a volume for said container;

wherein each of said plurality of sets of hypotenuse creases includes a first crease and a second crease, each of said first crease and said second crease extending upwardly from a corner edge of said container; and wherein said first crease and said second crease of each of said plurality of sets of hypotenuse creases extends upwardly toward a central axis of an end panel and terminates at an intersection thereof.

14. The container having a plurality of selectable volumes of claim 13, wherein each of said plurality of sets of hypotenuse creases extends upwardly from an intersection of said corner edge and a line of perforations.

15. The container having a plurality of selectable volumes of claim 14, wherein said at least one line of perforations includes an identifiable marking to facilitate identification of said at least one line of perforations on said two side panels and said two end panels.

16. The container having a plurality of selectable volumes of claim 13, wherein said first crease and said second crease of each of said plurality of sets of hypotenuse creases extends upwardly and terminates at an intersection with a line of perforations.

17. The container having a plurality of selectable volumes of claim 13, further including a plurality of fold facilitating creases laterally extending substantially across said two side panels and said two end panels to allow selective folding of said two side panels and said two end panels.

18. The container having a plurality of selectable volumes of claim 17, further including a vertical overlapping seam defined by an outer panel portion and an inner panel portion which overlap, a cutaway being provided on said inner panel portion and said outer panel portion having a fold facilitating crease.

19. The container having a plurality of selectable volumes of claim 17, wherein said plurality of fold facilitating creases are positioned on said two side panels and said two end panels at a height distance less than that of said plurality of lines of perforations.

20. The container having a plurality of selectable volumes comprising:

a bottom portion having a substantially rectangular shape with two substantially parallel side edges and two substantially parallel end edges;

two side panels attached to and extending upwardly from said two side edges of said bottom portion;

two end panels attached to and extending upwardly from said two end edges of said bottom portion, each of said two end panels having edges which are attached to edges of each of said two side panels to thereby form four corner edges of said container; and a separating means for allowing removal of at least a portion of said two side panels and said two end panels;

wherein each of said two end panels includes at least one set of hypotenuse creases adapted to allow said two end panels to be inwardly folded to thereby form a top closure for said container with a portion of said two side panels;

wherein said separating means is at least one of a line of perforations and a removal strip laterally extending substantially across said two side panels and said two end panels;

wherein said at least one set of hypotenuse creases on each of said two end panels is adapted to allow selective inward folding of said two side panels and said two end panels to thereby allow selection of a volume for said container;

wherein each of said plurality of sets of hypotenuse creases includes a first crease and a second crease, each of said first crease and said second crease extending upwardly from a corner edge of said container toward a central axis of an end panel and terminates at an intersection thereof;

wherein each of said plurality of hypotenuse creases extends upwardly from an intersection of said corner edge and said separating means; and further including a through hole positioned at an intersection of said central axis with said separating means.

21. The container having a plurality of selectable volumes of claim 20, wherein said central axis includes a vertical perforation extending between said separating means.

22. A container having a plurality of selectable volumes comprising:

a bottom portion having a substantially rectangular shape with two substantially parallel side edges and two substantially parallel end edges;

two side panels attached to and extending upwardly from said two side edges of said bottom portion;

two end panels attached to and extending upwardly from said two end edges of said bottom portion, each of said two end panels having edges which are attached to edges of each of said two side panels to thereby form four corner edges of said container; and at least one line of perforations laterally extending substantially across said two side panels and said two end panels to allow at least one of folding and removal of at least a portion of said two side panels and said two end panels;

wherein each of said two end panels includes at least one set of hypotenuse creases adapted to allow said two end panels to be inwardly folded to thereby form a top closure for said container with a portion of said two side panels;

wherein said at least one line of perforations is a plurality of lines of perforations laterally extending substantially across said two side panels and said two end panels;

wherein said at least one set of hypotenuse creases on each of said two end panels is a plurality of sets of hypotenuse creases adapted to allow selective inward folding of said two side panels and said two end panels to thereby allow selection of a volume for said container;

wherein each of said plurality of sets of hypotenuse creases includes a first crease and a second crease, each of said first crease and said second crease extending upwardly from a corner edge of said container;

wherein said first crease and said second crease of each of said plurality of sets of hypotenuse creases extends upwardly toward a central axis of an end panel and terminates at an intersection thereof;

further including a plurality of fold facilitating creases laterally extending substantially across said two side panels and said two end panels to allow selective folding of said two side panels and said two end panels;

wherein each of said plurality of sets of hypotenuse creases extends upwardly from an intersection of a corner edge and at least one of a line of perforations and a fold facilitating crease.

23. The container having a plurality of selectable volumes of claim 22, further including at least one vertical perforation to facilitate removal of said at least a portion of said two side panels and said two end panels.

24. The container having a plurality of selectable volumes of claim 23, wherein said at least one vertical perforation is positioned on at least one of said four corner edges of said container.

25. The container having a plurality of selectable volumes of claim 23, wherein at least one of said plurality of fold facilitating creases includes an identifiable marking to facilitate identification of said at least one of said plurality of fold facilitating creases on said two side panels and said two end panels.

26. The container having a plurality of selectable volumes comprising:

a bottom portion having a substantially rectangular shape with two substantially parallel side edges and two substantially parallel end edges;

two side panels attached to and extending upwardly from said two side edges of said bottom portion;

two end panels attached to and extending upwardly from said two end edges of said bottom portion, each of said two end panels having edges which are attached to edges of each of said two side panels to thereby form four corner edges of said container; and a separating means for allowing removal of at least a portion of said two side panels and said two end panels;

wherein each of said two end panels includes a plurality of sets of hypotenuse creases nested together which are adapted to allow said two end panels to be inwardly folded to thereby form a top closure for said container with a portion of said two side panels;

wherein said separating means is at least one of a line of perforations and a removal strip laterally extending substantially across said two side panels and said two end panels;

wherein said plurality of sets of hypotenuse creases on each of said two end panels is adapted to allow selective inward folding of said two side panels and said two end panels to thereby allow selection of a volume for said container;

wherein each of said plurality of sets of hypotenuse creases includes a first crease and a second crease, each of said first crease and said second crease extending upwardly from a corner edge of said container toward a central axis of an end panel and terminates at an intersection thereof;

wherein each of said plurality of hypotenuse creases extends upwardly from an intersection of said corner edge and said separating means.

27. The container having a plurality of selectable volumes comprising:

a bottom portion having a substantially rectangular shape with two substantially parallel side edges and two substantially parallel end edges;

two side panels attached to and extending upwardly from said two side edges of said bottom portion;

two end panels attached to and extending upwardly from said two end edges of said bottom portion, each of said two end panels having edges which are attached to edges of each of said two side panels to thereby form four corner edges of said container;

at least one line of perforations laterally extending substantially across said two side panels and said two end panels to allow at least one of folding and removal of at least a portion of said two side panels and said two end panels;

at least one fold facilitating crease laterally extending substantially across said two side panels and said two end panels to allow folding of said two side panels and said two end panels along said at least one fold facilitating crease;

wherein each of said two end panels includes at least one set of hypotenuse creases adapted to allow said two end panels to be inwardly folded to thereby form a top closure for said container with a portion of said two side panels;

wherein said at least one fold facilitating crease is a plurality of fold facilitating creases laterally extending substantially across said two side panels and said two end panels to allow selective folding of said two side panels and said two end panels;

wherein said at least one line of perforations is a plurality of lines of perforations laterally extending substantially across said two side panels and said two end panels to allow selective removal of said at least a portion of said two side panels and said two end panels;

wherein said at least one set of hypotenuse creases on each of said two end panels is a plurality of sets of hypotenuse creases nested together which are adapted to allow selective inward folding of said two side panels and said two end panels to thereby allow selection of a volume for said container;

wherein each of said plurality of sets of hypotenuse creases includes a first crease and a second crease, said first crease and said second crease extending upwardly toward a central axis of said two end panels and terminating at an intersection with a line of perforations and said central axis of said two end panels.

28. The container having a plurality of selectable volumes of claim 27, wherein said first crease and said second crease of each of said plurality of sets of hypotenuse creases are perforated.

29. The container having a plurality of selectable volumes of claim 28, wherein said at least one fold faciliting crease includes an identifiable marking to facilitate identification of said at least one of said plurality of fold facilitating creases on said two side panels and said two end panels.

30. The container having a plurality of selectable volumes comprising:

a bottom portion having a substantially rectangular shape with two substantially parallel side edges and two substantially parallel end edges;

two side panels attached to and extending upwardly from said two side edges of said bottom portion;

two end panels attached to and extending upwardly from said two end edges of said bottom portion, each of said two end panels having edges which are attached to edges of each of said two side panels to thereby form four corner edges of said container;

at least one line of perforations laterally extending substantially across said two side panels and said two end panels to allow at least one of folding and removal of at least a portion of said two side panels and said two end panels;

at least one fold facilitating crease laterally extending substantially across said two side panels and said two end panels to allow folding of said two side panels and said two end panels along said at least one fold facilitating crease;

wherein each of said two end panels includes at least one set of hypotenuse creases adapted to allow said two end panels to be inwardly folded to thereby form a top closure for said container with a portion of said two side panels;

wherein said at least one fold facilitating crease is a plurality of fold facilitating creases laterally extending substantially across said two side panels and said two end panels to allow selective folding of said two side panels and said two end panels;

wherein said at least one line of perforations is a plurality of lines of perforations laterally extending substantially across said two side panels and said two end panels to allow selective removal of said at least a portion of said two side panels and said two end panels;

wherein said at least one set of hypotenuse creases on each of said two end panels is a plurality of sets of hypotenuse creases adapted to allow selective inward folding of said two side panels and said two end panels to thereby allow selection of a volume for said container;

wherein each of said plurality of sets of hypotenuse creases includes a first crease and a second crease, said first crease and said second crease extending upwardly and terminating at an intersection with a line of perforations; and further including at least one vertical perforation to facilitate removal of said at least a portion of said two side panels and said two end panels.

31. The container having a plurality of selectable volumes of claim 30, wherein said at least one vertical perforation is positioned on at least one of said four corner edges of said container.

32. The container having a plurality of selectable volumes comprising:

a bottom portion having a substantially rectangular shape with two substantially parallel side edges and two substantially parallel end edges;

two side panels attached to and extending upwardly from said two side edges of said bottom portion;

two end panels attached to and extending upwardly from said two end edges of said bottom portion, each of said two end panels having edges which are attached to edges of each of said two side panels to thereby form four corner edges of said container;

at least one line of perforations laterally extending substantially across said two side panels and said two end panels to allow at least one of folding and removal of at least a portion of said two side panels and said two end panels;

at least one fold facilitating crease laterally extending substantially across said two side panels and said two end panels to allow folding of said two side panels and said two end panels along said at least one fold facilitating crease;

wherein each of said two end panels includes at least one set of hypotenuse creases adapted to allow said two end panels to be inwardly folded to thereby form a top closure for said container with a portion of said two side panels;

wherein said at least one fold facilitating crease is a plurality of fold facilitating creases laterally extending substantially across said two side panels and said two end panels to allow selective folding of said two side panels and said two end panels;

wherein said at least one line of perforations is a plurality of lines of perforations laterally extending substantially across said two side panels and said two end panels to allow selective removal of said at least a portion of said two side panels and said two end panels;

wherein said at least one set of hypotenuse creases on each of said two end panels is a plurality of sets of hypotenuse creases adapted to allow selective inward folding of said two side panels and said two end panels to thereby allow selection of a volume for said container;

wherein each of said plurality of sets of hypotenuse creases includes a first crease and a second crease, said first crease and said second crease extending upwardly and terminating at an intersection with a line of perforations; and further including a through hole positioned at said intersection with said line of perforations.

33. A container having a plurality of selectable volumes comprising:

a bottom portion having a substantially rectangular shape with two substantially parallel side edges and two substantially parallel end edges;

two side panels attached to and extending upwardly from said two side edges of said bottom portion;

two end panels attached to and extending upwardly from said two end edges of said bottom portion, each of said two end panels having edges which are attached to edges of each of said two side panels to thereby form four corner edges of said container;

a separating means for allowing removal of at least a portion of said two side panels and said two end panels;

wherein each of said two end panels includes a plurality of sets of hypotenuse creases adapted to allow said two end panels to be inwardly folded to thereby form a top closure for said container with a portion of said two side panels, said plurality of sets of hypotenuse creases being nested on said two end panels, and extending upwardly toward a central axis of said two end panels, each of said plurality of sets of hypotenuse creases terminating at an intersection with said central axis.

34. The container having a plurality of selectable volumes of claim 33, wherein said separating means is at least one of a perforation and a removal strip laterally extending substantially across said two side panels and said two end panels.

35. The container having a plurality of selectable volumes of claim 34, wherein said at least one set of hypotenuse creases on each of said two end panels is adapted to allow selective inward folding of said two side panels and said two end panels to thereby allow selection of a volume for said container.

36. The container having a plurality of selectable volumes of claim 35, wherein each of said plurality of sets of hypotenuse creases includes a first crease and a second crease, each of said first crease and said second crease extending upwardly from a corner edge of said container toward a central axis of an end panel and terminates at an intersection thereof.

37. A container having a plurality of selectable volumes comprising:

a bottom portion having a substantially rectangular shape with two substantially parallel side edges and two substantially parallel end edges;

two side panels attached to and extending upwardly from said two side edges of said bottom portion;

two end panels attached to and extending upwardly from said two end edges of said bottom portion, each of said two end panels having edges which are attached to edges of each of said two side panels to thereby form four corner edges of said container; and at least one line of perforations laterally extending substantially across said two side panels and said two end panels to allow at least one of folding and removal of at least a portion of said two side panels and said two end panels;

wherein each of said two end panels includes at least one set of hypotenuse creases adapted to allow said two end panels to be inwardly folded to thereby form a top closure for said container with a portion of said two side panels;

wherein said at least one line of perforations is a plurality of lines of perforations laterally extending substantially across said two side panels and said two end panels;

wherein said at least one set of hypotenuse creases on each of said two end panels is a plurality of sets of hypotenuse creases adapted to allow selective inward folding of said two side panels and said two end panels to thereby allow selection of a volume for said container;

wherein each of said plurality of sets of hypotenuse creases includes a first crease and a second crease, each of said first crease and said second crease extending upwardly from a corner edge of said container;

wherein said first crease and said second crease of each of said plurality of sets of hypotenuse creases extends upwardly toward a central axis of an end panel and terminates at an intersection thereof;

wherein said first crease and said second crease of each of said plurality of sets of hypotenuse creases extends upwardly and terminates at an intersection with a line of perforations; and further including a through hole positioned at said intersection with said line of perforations.

* * * * *